US006805082B2

(12) United States Patent
Takenaka et al.

(10) Patent No.: US 6,805,082 B2
(45) Date of Patent: Oct. 19, 2004

(54) VALVE TIMING ADJUSTMENT DEVICE

(75) Inventors: Akihiko Takenaka, Anjo (JP); Takayuki Inohara, Okazaki (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 0 days.

(21) Appl. No.: 10/695,201

(22) Filed: Oct. 29, 2003

(65) Prior Publication Data

US 2004/0084000 A1 May 6, 2004

(30) Foreign Application Priority Data

Oct. 31, 2002 (JP) ..... 2002-318836

(51) Int. Cl.[7] ..... F01L 1/34

(52) U.S. Cl. ..... 123/90.17; 123/90.15; 464/1; 464/15; 464/35

(58) Field of Search ..... 123/90.11–90.18, 123/90.27, 90.31; 464/1–6, 15, 16, 35, 45

(56) References Cited

U.S. PATENT DOCUMENTS 4,955,330 A * 9/1990 Fabi et al. ..... 123/90.17
6,502,537 B2 1/2003 Todo et al. ..... 123/90.17
6,510,826 B2 1/2003 Watanabe ..... 123/90.17
6,561,149 B1 * 5/2003 Kobayashi et al. ..... 123/90.17
6,672,264 B2 * 1/2004 Watanabe et al. ..... 123/90.17

FOREIGN PATENT DOCUMENTS

| | | |
|---|---|---|
| JP | 1-34012 | 5/1989 |
| JP | 1-134010 | 5/1989 |
| JP | 1-134011 | 5/1989 |
| JP | 5-248277 | 9/1993 |
| JP | 2001-41013 | 2/2001 |
| JP | 2002-227616 | 8/2002 |
| JP | 2002-227893 | 8/2002 |

* cited by examiner

*Primary Examiner*—Thomas Denion
*Assistant Examiner*—Kyle M. Riddle
(74) *Attorney, Agent, or Firm*—Nixon & Vanderhye P.C.

(57) ABSTRACT

A valve timing adjusting device sets an amount of phase shift of a driven shaft with respect to a drive shaft. A first hole in a first rotor forms a first track extending in order to vary its radial distance from a rotation center line. The first hole makes contact with a control member passing through the first track, on the two sides of the first hole toward which the first hole (the first rotor) rotates. A second hole in a second rotor forms a second track that extends. The second hole makes contact with the control member that passes through the second track. The first track and the second track slant toward each other in the rotation direction of the first and second rotor.

17 Claims, 19 Drawing Sheets

VALVE TIMING ADJUSTMENT DEVICE

CROSS REFERENCE TO RELATED APPLICATION

This application is based upon, claims the benefit of priority of, and incorporates by reference, the contents of Japanese Patent Application No. 2002-318836 filed Oct. 31, 2002.

BACKGROUND OF THE INVENTION

1. Field of the Invention

The present invention relates to a valve timing adjustment device for an internal combustion engine (hereinafter, "engine") for adjusting the timing (hereinafter, "valve timing") of at least one of an air intake valve and an exhaust valve.

2. Description of the Related Art

A conventional technique is known in which a valve timing adjustment device is provided to a transmission system for transmitting drive torque from a drive shaft (i.e., crankshaft) of an engine to a driven shaft (i.e., camshaft), to open and close an air intake valve and an exhaust valve of the engine, where the valve timing adjustment device adjusts the timing of the valves. According to the conventional technique, the valve timing adjustment device varies the rotational phase (below, simply "phase") of the camshaft with respect to the crankshaft. Varying the phase in this way adjusts the valve timing, which may improve engine power output, fuel consumption, etc.

Patent Document 1 (Japanese Patent Publication No. 2001-41013) recites one example of a valve timing adjustment device. The recited device has a first rotor rotated by means of the camshaft drive torque, and a second rotor that rotates together with the camshaft in the same direction as the first rotor. In this configuration, the second rotor is rotated relative to the first rotor to vary the camshaft phase with respect to the crankshaft.

According to the valve timing adjustment device recited in Patent Document 1, a moveable operating member is moved along a radial direction of the first rotor and the second rotor, and a link is used to convert the radial movement of the moveable operating member into rotational movements by the two rotors as relative to each other. According to this construction, the degree of phase shift by the second rotor with respect to the first rotor (and, therefore, the degree of phase shift by the camshaft with respect to the crankshaft) is dependent upon the length of the arm constituting the link. However, the length of this link, which enables the conversion of the movement, is limited. As a result, the degree of phase shift possible by the camshaft with respect to the crankshaft is also limited.

SUMMARY OF THE INVENTION

An object of the present invention is to provide a valve timing adjustment device that enables a great degree of freedom when setting the phase shift of a driven shaft with respect to a drive shaft.

According to a first aspect of a valve timing adjustment device of the present invention, a first hole in a first rotor forms a first track extending so as to vary its radial distance from a center rotation line, and the first hole makes contact with a control member passing through the first track, with the contact occurring on the two sides of the first hole toward which the first rotor rotates. Further, a second hole in a second rotor forms a second track extending so as to vary its radial distance from a center rotation line, and the second hole makes contact with the control member passing through the second track, with the contact occurring on the two sides of the second hole toward which the second rotor rotates. In addition, the first track and the second track slant toward each other in the rotational directions of the first rotor and the second rotor. Therefore, when the control means acts to change the control member's radial distance from the rotation centerline, the control member presses against at least one of the first hole and the second hole, whereby the control member passes through both the first track and the second track, and thus the second rotor is caused to rotate relative to the first rotor.

In the valve timing control device which operates in the foregoing manner, the degree of phase shift of the second rotor with respect to the first rotor is dependent upon the length of the first track and the second track and the degree to which the first track and the second track slant toward each other. By extending the first track and the second track such that they vary their radial distances from the rotation centerline, relative freedom is achieved in determining the length and the mutual slant of the tracks. In turn, this increases freedom in setting the degree of phase shift of the second rotor with respect to the first rotor, and therefore, the degree of phase shift of the driven shaft with respect to the drive shaft.

Note, however, that the mutually slanting first track and second track may be formed to intersect each other, or may also be formed in such that they do not intersect each other. According to a second aspect of the valve timing adjustment device of the present invention, the first rotor and the second rotor each have a plurality of pairs of the first hole and the second hole, arranged along the direction of rotation, such that each pair corresponds separately to each of a plurality of control members. Such a configuration alleviates unbalanced weight distribution around the rotation centerline.

According to a third aspect of the above-mentioned valve timing adjustment device of the present invention, an energizing means energizes one of the first rotor and the second rotor so as to advance that one rotor toward its direction of rotation, and energizes the other rotor so as to retard its movement toward its direction of rotation. A first wall portion formed to either the first rotor or the second rotor forms a first track extending so as to vary its radial distance from the rotation centerline, and the first wall portion makes contact with the control member passing through the first track in such a way that the contact occurs on the retardation side in terms of that rotor's direction of rotation.

Further, a second wall portion formed to the other rotor forms a second track extending so as to vary its radial distance from the rotation centerline, with the second wall making contact with the control member passing through the second track in such a way that the contact occurs on the advancement side in terms of the second rotor's direction of rotation. Here, the first track and the second track slant toward each other along the directions of rotation of the first rotor and the second rotor. Therefore, when the control means varies the control member's radial distance from the rotation centerline, the following operations occur in accordance with the direction in which the radial distance is being changed.

First, the energizing means causes the first wall portions and the second wall portions to be pressed against the control members, whereby the control members are caused to pass through the first track and the second track, and the second rotor is caused to rotate toward the advancement side or toward the retardation side relative to the first rotor. Second, at least one of the first wall portion and the second wall portion is pressed by the control member, whereby the control member is caused to pass through the first track and the second track, and the second rotor is caused to rotate toward the advancement side or toward the retardation side relative to the first rotor.

In the valve timing adjustment device operating in the foregoing manner, the degree of phase shift of the second rotor with respect to the first rotor is dependent upon the length of the first track and the second track and the degree to which the first track and the second track slant toward each other. By extending the first track and the second track such that each track varies its radial distance from the rotation centerline, relative freedom is achieved for setting the length and the mutual slant of the two tracks. In turn, this increases the degree of freedom in setting the degree of the phase shift of the second rotor with respect to the first rotor, and therefore, the degree of the phase shift of the driven shaft with respect to the drive shaft. Note, however, that the first track and the second track, which slant toward each other, may be configured such that they intersect with each other, or may be configured such that they do not intersect with each other.

According to a fourth aspect of the valve timing adjustment device of the present invention, it is further desirable that the first rotor and the second rotor have a plurality of pairs of the first wall portion and the second wall portion arranged along the rotational direction of the rotor, with each of the pairs of wall portions corresponding individually to each of a plurality of control members. Such a construction alleviates unbalanced weight distribution around the rotation centerline.

According to a fifth aspect of the valve timing adjustment device of the present invention, the first track and the second track are formed as straight lines. This configuration facilitates working on the holes and the wall portions forming the two tracks.

According to a sixth and a seventh aspect of the present invention, the first track and the second track are formed as curved lines. This configuration facilitates setting the correlation between the control members' radial distance from the rotation centerline, and the rotational phase of the second rotor with respect to the first rotor (e.g., a simple proportional relationship can be taken advantage of).

According to an eighth aspect of the valve timing adjustment device of the present invention, the first track and the second track intersect each other at places determined by the rotational phase of the second rotor with respect to the first rotor, and the bar-shaped control member passes through the point of intersection between the first track and the second track. This configuration is a simplified construction.

According to a ninth aspect of the present invention, the control member has individual rolling elements at the point where it makes contact with the first rotor and at the point where it makes contact with the second rotor. Because of this configuration, when the control member reverses the direction in which its radial distance from the rotation centerline is being changed, the second rotor can smoothly change its direction of rotation with respect to the first rotor.

According to a tenth aspect of the valve timing adjustment device of the present invention, the control holes in the control rotor form control tracks extending at a slant with respect to the radial axis line, so as to vary their radial distance from the rotation centerline, with the control holes making contact with the control member passing through the control hole. This contact occurs on both the radially inward side and the radially outward side of the control hole. Therefore, when the torque application means applies the advancement side torque or the retardation side torque to the control rotor, and the control rotor rotates relative to the first rotor to pass through the control track, the control hole presses against the control member, thus varying the radial distance of the control member from the rotation centerline.

According to an eleventh aspect of the valve timing adjustment device of the present invention, supplementary energizing means energizes the control member in one direction along the radius of the control rotor. Furthermore, the control holes in the control rotor form the control tracks extending at a slant with respect to the rotation centerline so as to vary their radial distance from the rotation centerline, with the control hole making contact with the control member passing through the control track, and with this contact occurring on either the radially inward side or the radially outward side of the control hole. Therefore, when the torque application means applies either the advancement side torque or the retardation side torque onto the control rotor, and the control rotor rotates relative to the first rotor, the control member is pressed by the supplementary energizing means toward the control wall portion, and thus passes through the control track, thereby changing the radial distance of the control member from the rotation centerline. Moreover, when the torque application means applies the opposite torque to the control rotor, and the control rotor rotates relative to the first rotor, the control member receives pressure from the control wall portion and thus passes through the control track, thereby changing the radial distance of the control member from the rotation centerline.

According to a twelfth aspect of the valve timing adjustment device of the present invention, the control track is formed as an arc arranged off-center from the rotation centerline. This configuration reduces the couple of forces bearing on the control member due to the action force of the first rotor, the second rotor, and the control rotor.

According to a thirteenth aspect of the valve timing adjustment device of the present invention, the control track is formed in a spiraling pattern. This configuration decreases the couple of forces bearing on the control member due to the action force of the first rotor, the second rotor, and the control rotor.

According to a fourteenth aspect of the valve timing adjustment device of the invention, the control track is formed as a straight line. This configuration facilitates working on the control hole and the control wall portion forming the control track.

According to a fifteenth aspect of the valve timing adjustment device, the ends of the control track are formed roughly at right angles with respect to the radial axis line of the control rotor. This configuration decreases the rate of change of the control member's radial distance from the rotation centerline as it passes through to the end of the control track. This prevents the control member from having to make a forceful collision with the control hole or the control wall portion at the ends of the control path. As a result, loud noise, damage and the like caused by such collisions can be prevented.

According to a sixteenth aspect of the valve timing adjustment device, the control means is provided with a holding means which maintains the rotational position of the control rotor with respect to the first rotor, at a time when the torque application means is not applying torque to the control rotor. This configuration enables the rotational phase of the control rotor with respect to the first rotor to be maintained at a desired phase without depending on the torque application means, at times such as immediately after the engine is started, or when the engine is off. Moreover, by maintaining the rotational phase of the first rotor, the rotational phase of the driven shaft with respect to the drive shaft can also be maintained as desired.

According to a seventeenth aspect of the valve timing adjustment device, the torque application means has an electric motor for generating the torque applied to the control rotor. This configuration simplifies construction of the torque application means and guarantees generation of the torque to be applied to the control rotor.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

First Embodiment

FIGS. 1–9 illustrate a valve timing adjustment device for use in an engine, in accordance with a first embodiment of the present invention. A valve timing adjustment device 10 of the present embodiment controls the valve timing of an air intake valve of an engine.

The valve timing adjustment device 10 is provided to a transmission system for transmitting drive torque of an engine crankshaft (not shown in the diagram) to an engine camshaft 4. The camshaft 4 rotates around a rotation centerline 0 to drive the opening and closing of the engine's air intake valve. The crankshaft constitutes a drive shaft, and the camshaft 4 constitutes a driven shaft.

Figure 1:
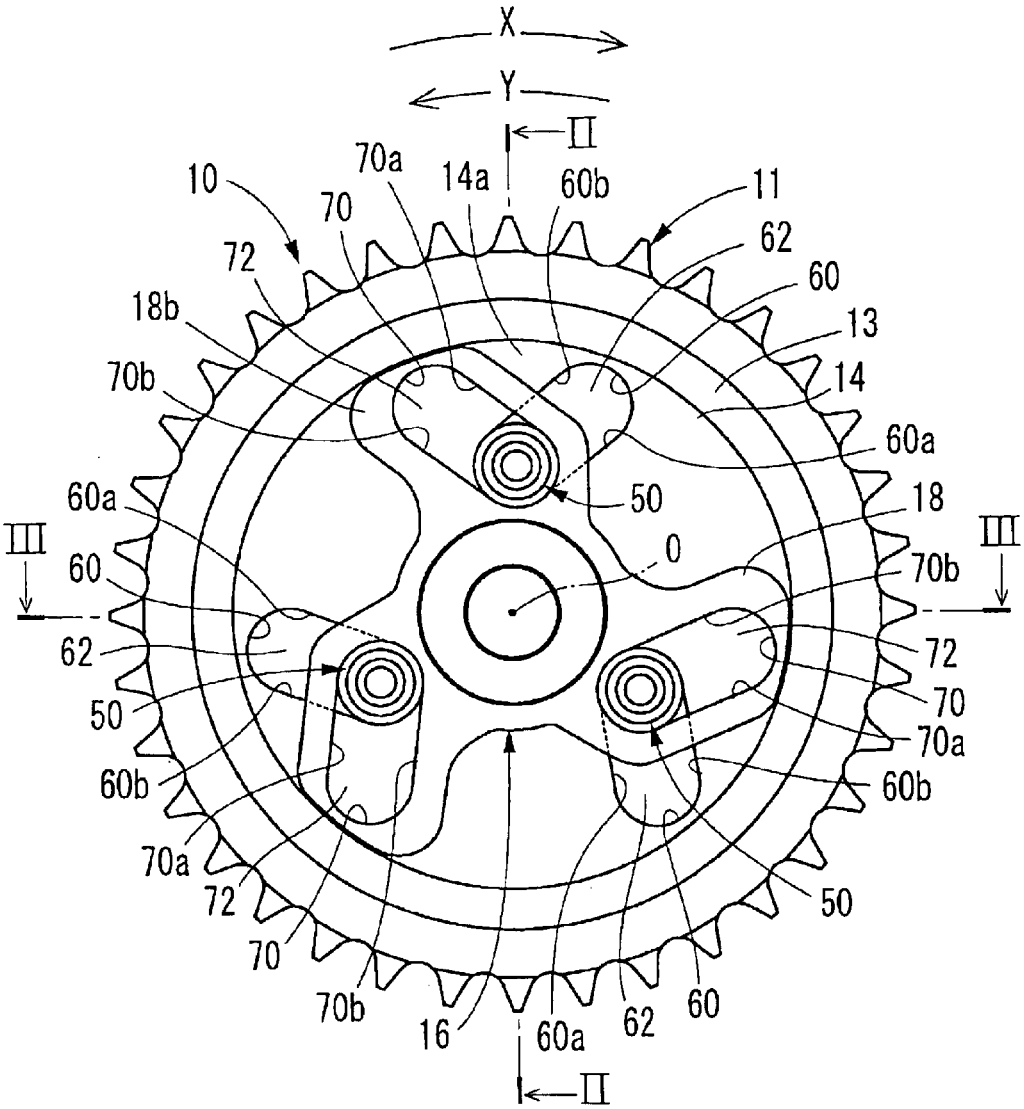
FIG. 1 is a schematic view taken along line I—I in FIG. 2 of a valve timing adjustment device in an operational state according to a first embodiment of the present invention.

A sprocket 11, which serves as a first rotor, has a support cylinder 12, an input cylinder 13 having a longer radius than the supporting cylinder 12, and a converter 14 for connecting the support cylinder 12 and the input cylinder 13, such that the cylinders form a series of steps. The support cylinder 12 is supported by the outside wall of an output shaft 16 and the camshaft 4 in such a way that the support cylinder 12 can rotate around the rotation centerline 0. A chain (not shown in the diagram) wraps around a plurality of gear teeth 13*a* provided to the input cylinder 13, and a plurality of gear teeth provided to the crankshaft. When the drive torque from the crankshaft is input through the chain into the input cylinder 13, the sprocket 11 maintains its phase relationship to the crankshaft as it rotates around the rotation centerline 0 in a clockwise direction as seen in FIG. 1.

Figure 5:
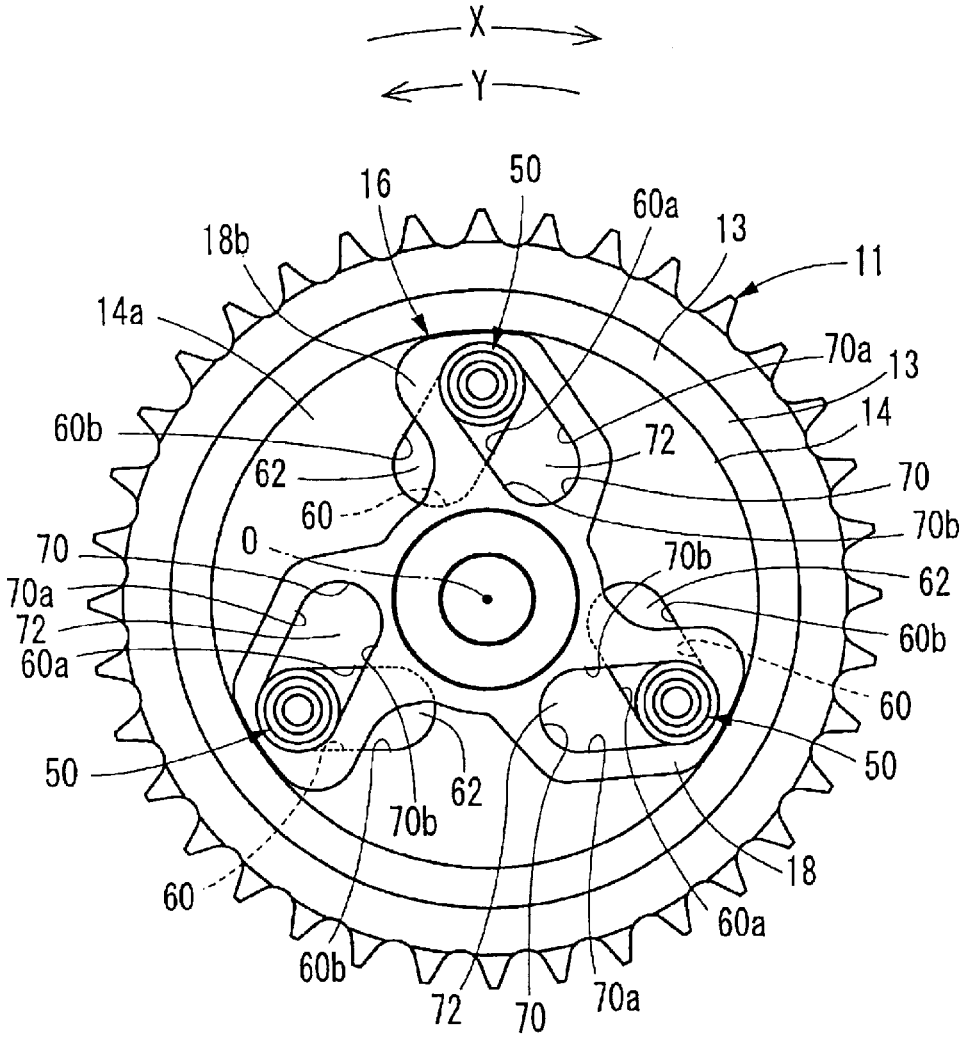
FIG. 5 is schematic view taken along a line I—I in FIG. 2, of another operational state of the valve timing adjustment device according to the first embodiment of the present invention.
Figure 6:
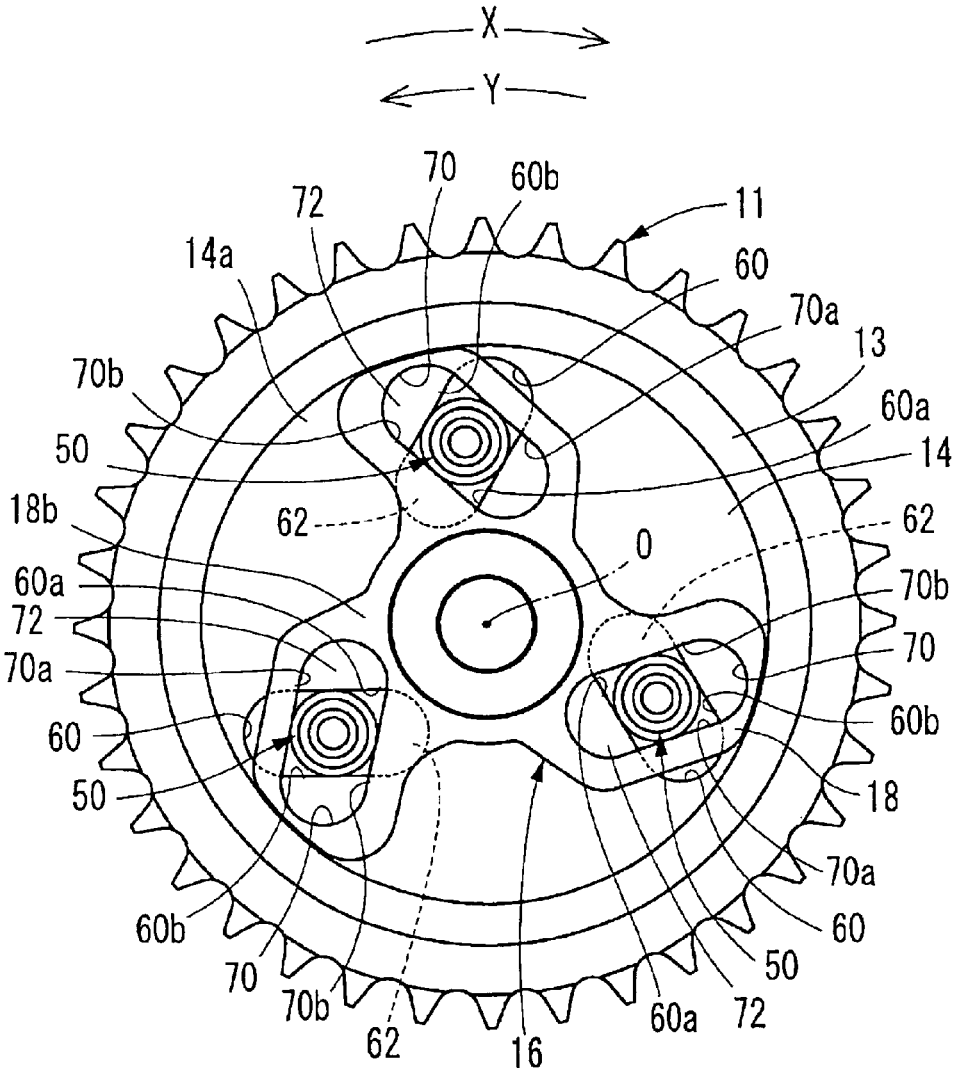
FIG. 6 is a schematic view, taken along a line I—I in FIG. 2, of another operational state of the valve timing adjustment device according to the first embodiment of the present invention.

The output shaft 16, which serves as a second rotor, has a fixed portion 17 and a conversion portion 18. The fixed portion 17 is fitted concentrically with the camshaft 4 around the outside of one end of the camshaft 4, and is connected in a fixed fashion to the camshaft 4 by means of a bolt. The conversion portion 18 is held by a planetary gear 23 and a rotating member 24 between a cover 15 fixed to the input cylinder 13 and a conversion portion 14, and is in contact with an inner wall 14*a* of the conversion portion 14, facing opposite to an outer wall 24*a* of the rotating member 24. A control pin 50 connects the conversion portion 18 and the conversion portion 14. This connection causes the output shaft 16 to rotate around the rotation centerline 0 to make the camshaft 4 rotate simultaneously, together with the rotation of the sprocket 11. Now, the output shaft 16 rotates in the same direction as the sprocket 11 (i.e., clockwise as viewed in FIG. 1). Further, the connection enables the output shaft 16 to rotate in both directions relative to the sprocket 11 (i.e., toward the advancing side X or toward the retarding side Y). Note that FIG. 1, FIG. 5 and FIG. 6 show the output shaft 16 in its most retarded state, its most advanced state, and in a middle state, respectively, in terms of its rotational phase with respect to the sprocket 11. The structure of the connection between the conversion portions 18, 14 and the control pin 50 is described in detail below.

Figure 2:
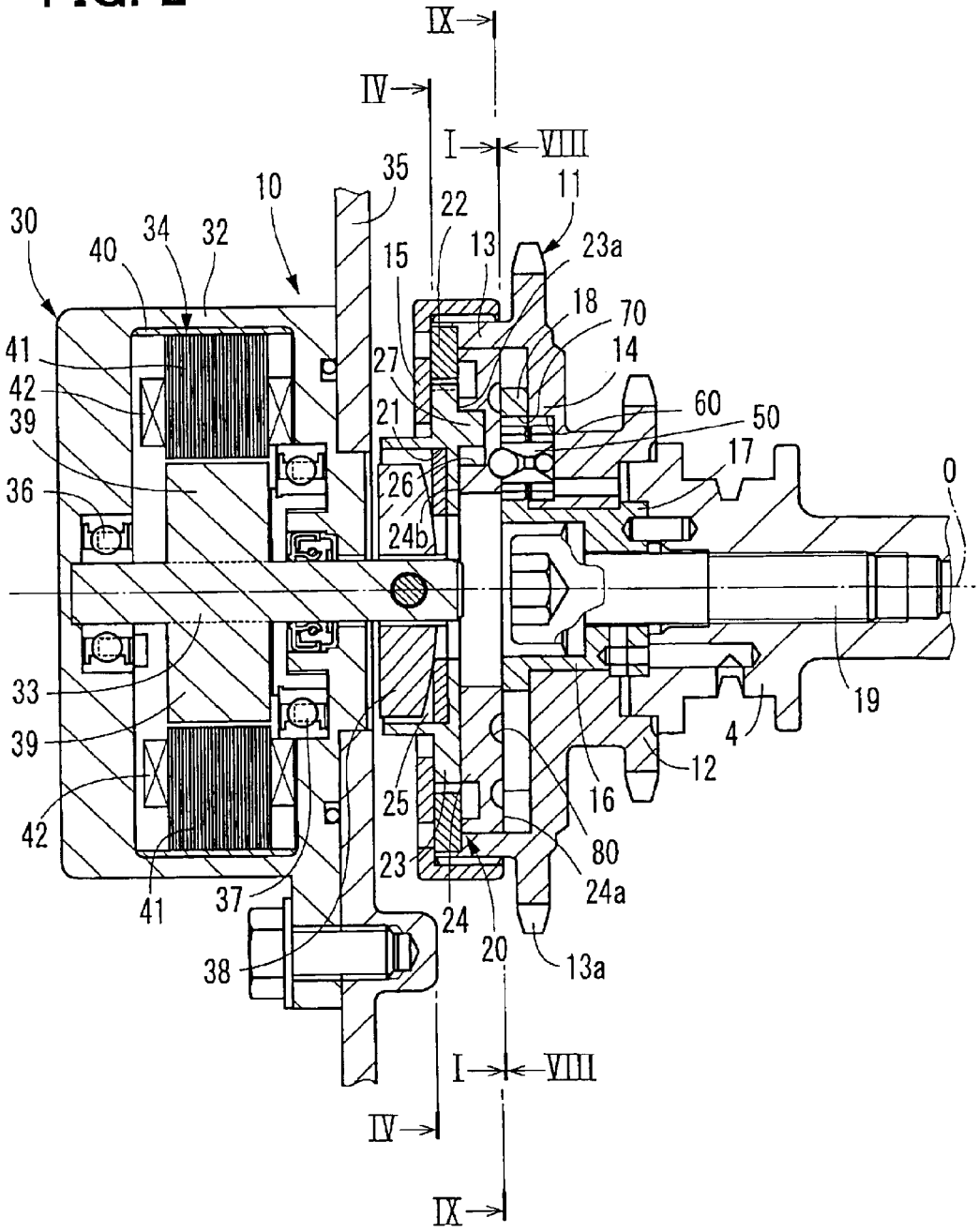
FIG. 2 is a cross-sectional view taken along a line II—II in FIG. 1.
Figure 3:
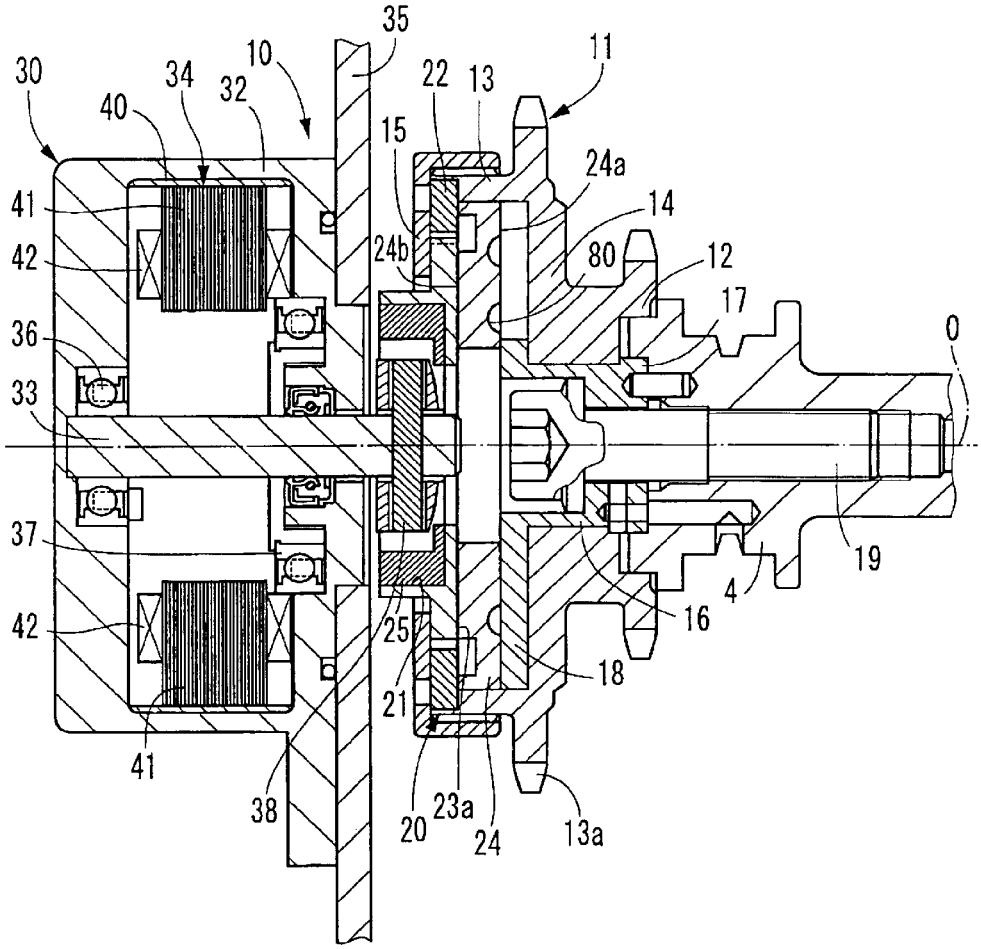
FIG. 3 is a cross-sectional view taken along a line III—III in FIG. 1.
Figure 4:
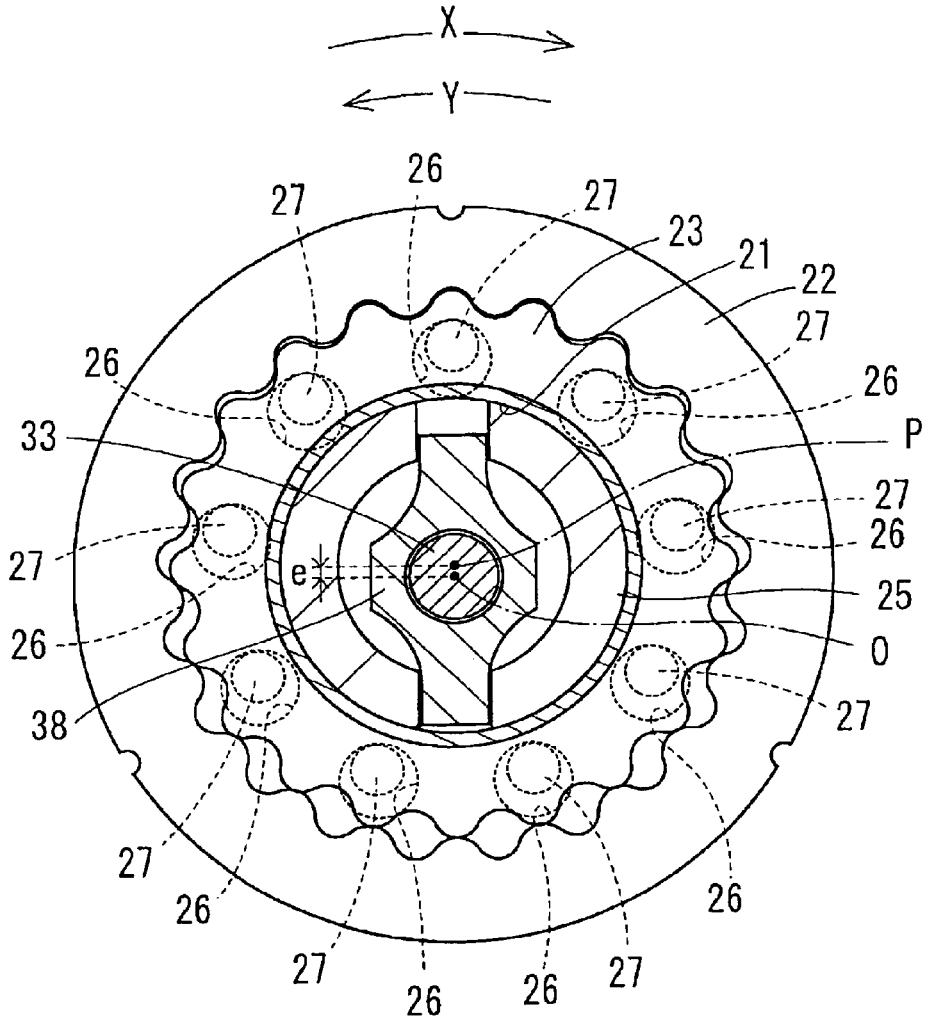
FIG. 4 is a cross-sectional view taken along a line IV—IV in FIG. 2.

An electric motor 30 such as shown in FIG. 2 and FIG. 3 has a housing 32, a working shaft 33, an electromagnetic portion 34, etc. The housing 32 is fixed to the engine by a stay 35. Bearings 36, 37 in the electromagnetic portion 34 affix the working shaft 33 to the housing 32 in such a way that it can rotate around the rotation centerline 0. The working shaft 33 is connected to a rotating shaft 25 through a shaft coupling 38. This shaft coupling 38 enables the working shaft 33 to rotate as a single unit with the rotating shaft 25 around the rotation centerline 0 in a clockwise direction as seen in FIG. 4. The working shaft 33 is provided with electromagnetic portions 39 protruding outward along the radial direction forming a magnetic pole at the end of the protrusion. The magnetic portions 39 may be made with a rare earth magnet, for example, forming protruding magnetic poles at two points facing each other around the rotation centerline 0.

The electromagnetic portion 34 is fixed to the engine by the housing 32 and the stay 35 such that it cannot be displaced. Furthermore, the electromagnetic portion 34 is arranged at a distance from the centerline 0 of the working shaft 33. The electromagnetic portion 34 includes a cylindrical main unit 40, four core portions 41, four coils 42, and the above-mentioned bearings 36, 37. Each of the core portions 41 are formed with layered iron scraps, and are positioned on the inner wall of the main unit 40 at equidistant points around the rotation centerline 0, protruding inward toward the working shaft 33. The coils 42 are wound inside the core portions 41. The directions in which each of the coils 42 is wrapped is set as follows: when viewing from the protrusion end of the opposing core portion 41, opposite coils 42 are wrapped in opposite directions. The electromagnetic portion 34 forms a magnetic field on the outer side of the working shaft 33 when electricity flows through the coils 42 from a conduction control circuit (not shown).

The conduction of electricity into the coil 42 by the conduction control circuit is executed such that the magnetic field formed by the coils 42 applies to the working shaft 33 a torque Tx on the advancement side X (below, "advancement side torque Tx"), and a torque TY on the retardation side (below, "retardation side torque TY"). More specifically, the same-phase alternating current is provided to coils 42 that face each other, and an alternating current phased at −90° is provided to coils 42 that are next to each other. This causes each coil 42 to form a rotating magnetic field that rotates around the outside of the working shaft 33 in the clockwise direction as viewed in FIG. 4.

When the electromagnetic portion 39 of the working shaft 33 receives the drawing force and the repelling force of the magnetic field, this produces advancement side torque Tx on the working shaft 33, which is then transmitted to the rotating shaft 25. On the other hand, when the same-phase alternating current is supplied to coils 42 which face each other and an alternating current phased at +90° is supplied to coils 42 which are next to each other, this forms a rotating magnetic field which rotates around the outside of the working shaft 33 in a counter-clockwise direction as viewed in FIG. 4. When the electromagnetic portion 39 of the working shaft 33 receives the drawing force and the repelling force of the magnetic field, this produces retardation side torque TY on the working shaft 33, which is then transmitted to the rotating shaft 25. Note that the construction of the electric motor 30 that generates the advancement side torque Tx and the retardation side torque TY can also be made according to a commonly known electric motor instead of using the construction described above.

As shown in FIG. 2 and FIG. 4, a speed reducer 20 is constructed with a ring gear 22, the rotating shaft 25, the planetary gear 23, the rotating member 24, etc. The ring gear 22 is fixed to the inner wall of the input cylinder 13, concentrically with the input cylinder 13. The ring gear 22 is constructed with an internal gear (i.e., the internal circumference measured at the tips of the gear teeth is smaller than the internal circumference measured at the valleys between the gear teeth). The ring gear 22 rotates as a single unit with the sprocket 11 around the rotation centerline 0 in a clockwise direction as viewed in FIG. 4.

The rotating shaft 25 is connected to the working shaft 33 of the electric motor 30, arranged off-center from the rotation centerline 0. In FIG. 4, P indicates the centerline of the rotating shaft 25, and e indicates the degree of eccentricity of the rotating shaft 25 with respect to the rotation centerline 0.

The planetary gear 23 is arranged such that planetary movement is possible inside the ring gear 22. The planetary gear 23 is composed of an external gear (i.e., the gear circumference as measured around the tips of the gear teeth is larger than the circumference as measured at the valleys between the gear teeth). The radius of curvature of the external circumference around the planetary gear 23 is smaller than the radius of curvature of the internal circumference of the ring gear 22, and the number of teeth on the planetary gear 23 is one smaller than the number of teeth on the ring gear 22. The planetary gear 23 is formed with a fitting hole 21 formed to have a circular cross section. The centerline of the fitting hole 21 is aligned with the centerline of the planetary gear 23. One end of the rotating shaft 25 passes through a bearing (not shown in the diagram) and is fitted into the fitting hole 21. The planetary gear 23 is supported by the outer wall of the rotating shaft 25 in such a way as to be able to rotate relatively around the centerline P of the rotating shaft 25, and in this relationship a portion of the teeth of the planetary gear 23 mesh with a portion of the teeth of the ring gear 22.

The rotating member 24 serving as a control rotor is formed as a round plate, and is supported on the inside wall of the input cylinder 13 of the sprocket 11 in such a way as to be able to rotate relatively around the rotation centerline 0. Nine meshing holes 26 are arranged equidistant from one another in the rotating member 24. Each of the meshing holes 26 is formed to have a circular cross section, and open toward an outer wall 24*b* of the rotating member 24 being in contact with the planetary gear 23. An outer wall 23*a* of the planetary gear 23 that is in contact with the rotating member 24 is formed with meshing protrusions 27 at nine locations positioned so as to face each of the meshing holes 26. The meshing protrusions 27 are provided equidistant from each other around the centerline P of the rotating shaft 25, which is displaced off the rotation centerline 0 by an eccentricity amount e. Each meshing protrusion 27 exhibits a cylindrical shape protruding toward the rotating member 24, and extends into its corresponding meshing hole 26. The radius of each meshing protrusion 27 is smaller than the radius of the meshing holes 26. The control pin 50 is connected to the outer wall 24*a* on the reverse planetary gear side of the rotating member 24 (i.e., the side where the conversion portion 18 is located). The structure of the connection between the rotating member 24 and the control pin 50 is described in detail below.

When torque is not being transmitted from the working shaft 33 of the electric motor 30 to the rotating shaft 25, the rotational movement of the planetary gear 23 relative to the rotating shaft 25 does not occur, and the planetary gear 23 rotates as a single unit meshed with the sprocket 11 and the rotating shaft 25, without losing its relative relationship to the ring gear 22. When this happens, the meshing protrusions 27 press against the inner walls of the meshing holes 26 toward the advancement side X. This meshing action enables the rotating member 24 to keep its phase relationship with respect to the sprocket 11 as it rotates around the rotation centerline 0 in the clockwise direction as viewed in FIG. 4.

When the retardation side torque TY is transmitted from the working shaft 33 to the rotating shaft 25 in this state, the rotating shaft 25 rotates relative to the sprocket 11 around the rotation centerline 0 in the direction toward the retardation side Y. Then, the outer wall of the rotating shaft 25 presses against the planetary gear 23, and thereby the planetary gear 23 rotates relative to the rotating shaft 25 around the centerline P toward the advancement side X with the action of the ring gear 22 meshed therewith. Furthermore, in this case, the planetary gear 23 rotates relative to the sprocket 11 toward the advancement side X while it is partially meshed with the ring gear 22. This increases the torque TY with its direction changed into the advancement side X direction. Then, the respective meshing protrusions 27 press against the corresponding meshing holes 26 toward the advancement side X to transmit the torque TY to the rotating member 24. As a result, the rotating member 24 rotates relative to the sprocket 11 around the rotation centerline 0 toward the advancement side X.

On the other hand, when the advancement side torque Tx is transmitted from the working shaft 33 to the rotating shaft 25, the rotating shaft 25 rotates around the rotation centerline 0 toward the advancement side X as relative to the sprocket 11. Therefore, the outer wall of the rotating shaft 25 presses against the planetary gear 23, and thereby the planetary gear 23 rotates relative to the rotating shaft 25 around the centerline P toward the retardation side Y with the action of the ring gear 22. Furthermore, the planetary gear 23 rotates relative to the sprocket 11 toward the retardation side Y while it is partially meshed with the ring gear 22. Accordingly, this increases the torque TX with its direction changed into the retardation side Y direction. Then, the respective meshing protrusions 27 press against the corresponding meshing holes 26 toward the retardation side Y to transmit the torque TX to the rotating member 24.

Note, however, that the speed reducer 20 does not have to have the construction described above. A commonly known construction for a speed reducer may also be used. Further, the speed reducer 20 does not have to be provided. The torque generated by the electric motor 30 may be transmitted directly to the rotating member 24.

As discussed, the electric motor 30 and the speed reducer 20 constitute the torque application means.

Next, FIG. 1, FIG. 2 and FIGS. 5 to 9 are referenced to describe the structure connecting the conversion portion 14 of the sprocket 11, the conversion portion 18 of the output shaft 16 and the rotating member 24, and the control pin 50 which functions as the control member. (Note, however, that hatching for indicating the cross-sectional view is omitted in FIG. 1, FIG. 5, FIG. 6, and FIG. 9.

Figure 7:
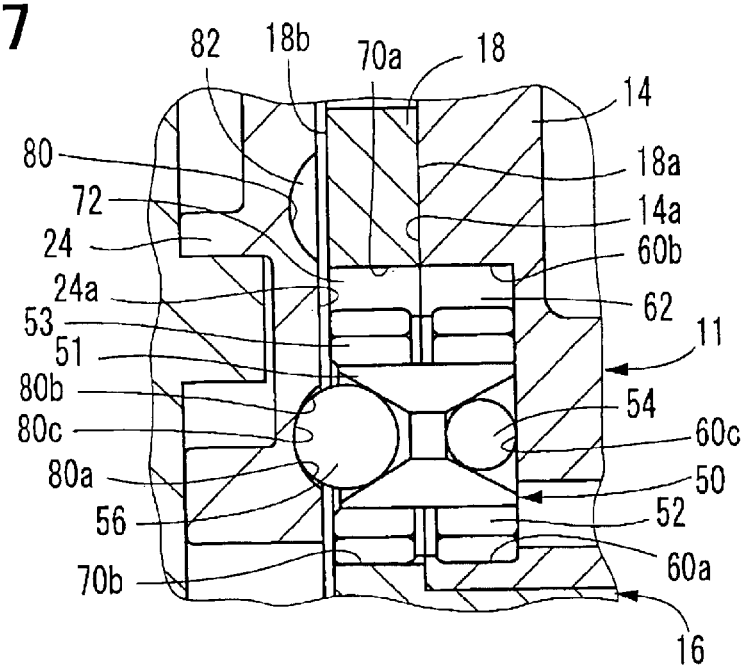
FIG. 7 is an enlarged, cross-sectional view of a portion of FIG. 2.

As shown in FIG. 1, the conversion portion 14 is shaped as a round disk arranged perpendicularly to the rotation centerline 0, having holes 60 provided at three points. The holes 60 are formed such if one were rotated 120° around the rotation center line 0 it would overlap with another. As shown in FIG. 1 and FIG. 7, the holes 60 open toward an inner wall 14*a* of the conversion portion 14 which is in contact with the conversion portion 18. Each of the holes 60 is formed such that its inner wall forms a track 62 through which the control pin 50 passes. The tracks 62 formed by each of the holes 60 slant toward the radial axis line of the conversion portion 14, thus varying its radial distance from the rotation centerline 0. In the present embodiment, the tracks 62 formed by each of the holes 60 extend in a straight line, and slant toward the advancement side X relative to the radial axis line as they move away from the rotation centerline 0.

As shown in FIG. 1, the conversion portion 18 is formed roughly in the shape of a triangular plate arranged perpendicularly to the rotation centerline 0, and holes 70 are provided at three points to face the holes 60 in the respective conversion portion 14. The holes 70 are formed at the three apexes of the conversion portion 18 such that if one of the holes 70 were rotated 120° around the rotation centerline 0 it would overlap with another. As shown in FIG. 1 and FIG. 7, the holes 70 pass through the width of the conversion portion 18, and open from its outer wall 18*a* which is in contact with the conversion portion 14, and from its outer wall 18*b* facing the rotating member 24. Each of the holes 70 is formed such that its inner wall forms a track 72 through which the control pin 50 passes. The track 72 formed by each of the holes 72 slants with respect to the radial axis line of the conversion portion 18, thus varying its radial distance from the rotation centerline 0.

In the present embodiment, the tracks 72 formed by the holes 70 extend in straight lines such that they slant toward the retardation side Y with respect to the radial axis line as they move away from the rotation centerline 0. According to this structure, the tracks 72 formed by the holes 70, and the tracks 62 formed by the holes 60 which face the holes 70, intersect each other at locations determined by the rotational phase of the output shaft 16 with respect to the sprocket 11, and slant toward each other in the direction of rotation.

Note, however, that it is also possible to form either the tracks 62 (formed by the holes 60) or the tracks 72 (formed by the holes 70) such that they do not slant with respect to the radial axis line. Further, it is also possible to form the tracks 62 (formed by the holes 60) such that they slant toward the retardation side Y with respect to the radial axis line as they move away from the rotation centerline 0, and form the tracks 72 (formed by the holes 70) such that they slant toward the advancement side X with respect to the radial axis line as they move away from the rotation centerline 0.

As shown in FIG. 1, three control pins 50 are provided and arranged individually such that each one corresponds to one of the three pairs of holes 60 and holes 70. As shown in FIG. 2, each control pin 50 is shaped as a bar extending parallel to the rotation centerline 0, and is held between the conversion portion 14 and the rotating member 24 such that it passes through the point where the tracks 62, 72 (formed by the holes 20, 70) intersect each other. As shown in FIG. 1 and in FIGS. 5–7, the holes 60 are in contact with the control pins 50 along sidewalls 60*a*, 60*b* of the tracks 62, and the holes 70 are in contact with the control pins 50 along sidewalls 70*a*, 70*b* of the tracks 72. These sidewalls are the sidewalls on either side of the two directions of rotation. The control pins 50 have a rolling element 52 at a location that is in contact with the hole 60, and a rolling element 53 at a location that is in contact with the hole 70. According to the present embodiment, the rolling elements 52, 53 are constructed as dual layer cylinders covering the cylindrical main body 51 of the control pin 50, with a small cylindrical member and a large cylindrical member along the same axis, as shown in FIG. 7. However, a different construction may be used for the rolling elements 52, 53. One end of each control pin 50 is also provided with a ball member 54 that is in contact with a bottom wall 60*c* of the corresponding hole 60.

Figure 8:
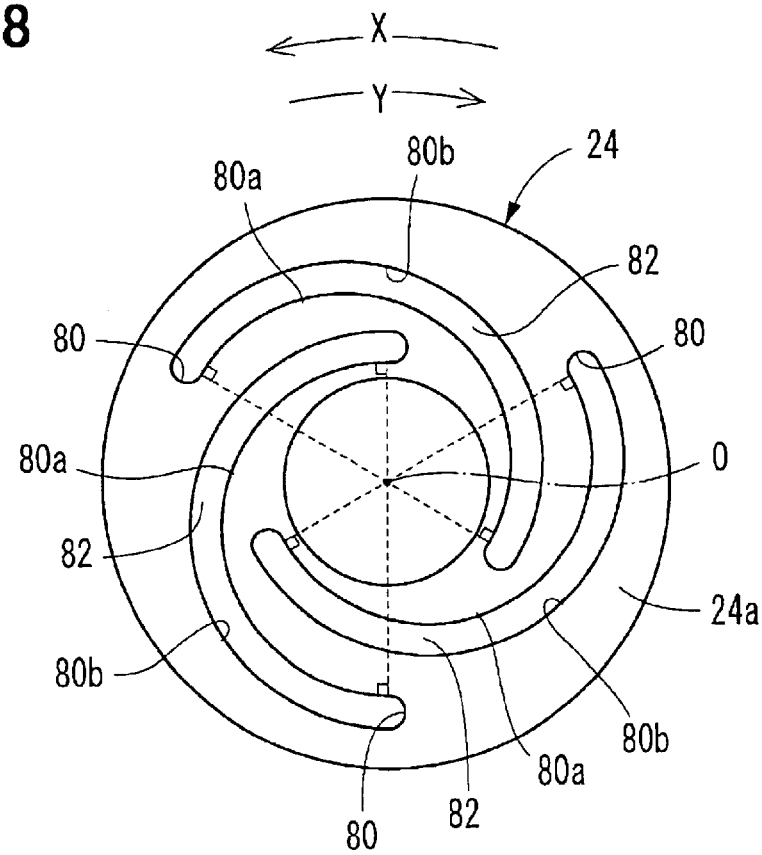
FIG. 8 is a schematic view, taken along a line VIII—VIII in FIG. 2, illustrating a rotating member of the valve timing adjustment device according to the first embodiment of the present invention.
Figure 9:
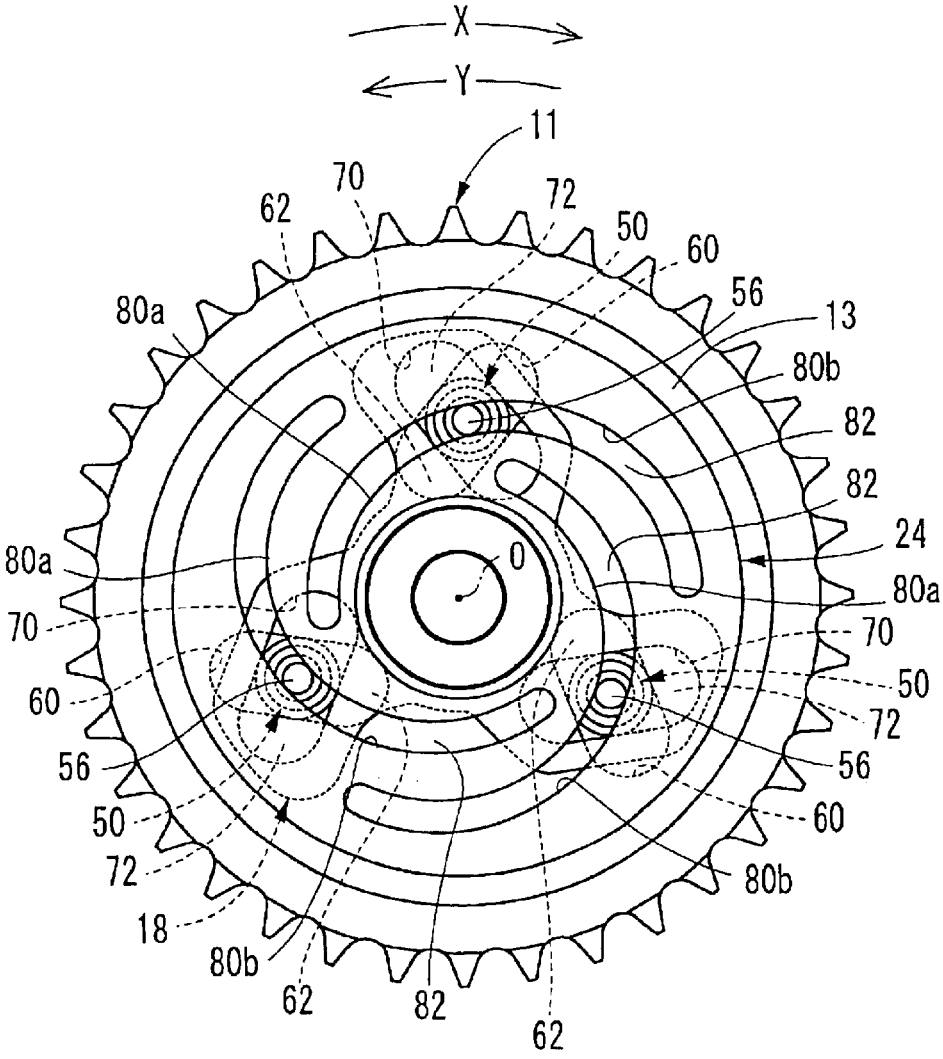
FIG. 9 is a schematic view taken along a line IX—IX in FIG. 2.

As shown in FIG. 8 and FIG. 9, holes 80 are provided to three locations on the rotating member 24. Each hole 80 is formed such that if one of the holes 80 were rotated 120° around the rotation centerline 0 it would overlap with another. Each hole 80 opens toward the outer wall 24*a* (of the rotating member 24) that faces the conversion portion 18. Each hole 80 is formed such that its inner wall forms a track 82 through which the control pin 50 passes. The tracks 82 formed by the holes 80 slant with respect to the radial axis line of the rotating member 24, so as to vary its radial distance from the rotation centerline 0. In accordance with the present embodiment, the tracks 82 formed by the holes 80 extend in an arc shape arranged off-center from the rotation centerline 0, and are slanted toward the advancement side X with respect to the radial axis line as they move away from the rotation centerline 0. Particularly as shown in FIG. 9, each of the tracks 82 formed by the holes 80 are configured so as to intersect with one of the tracks 62, 72 formed by the holes 60, 70. Furthermore, in accordance with the present embodiment, both ends of the tracks 82 formed by the holes 80 are roughly at right angles with respect to the radial axis line of the rotating member 24. Note, however, that the tracks 82 formed by the holes 80 may also slant toward the retardation side Y with respect to the radial axis line as they move away from the rotation centerline 0.

As shown in FIG. 7 and FIG. 9, a ball member 56 (which is provided to an end of the control pin 50 opposite from the end on which the ball member 54 is provided) passes through each track 82 formed by the hole 80. Each hole 80 is in contact with the ball member 56 of the control pins 50 along sidewalls 80*a*, 80*b* of the tracks 82 in the radial direction. Each hole 80 is in contact with the ball member 56 at a bottom wall 80*c* which connects smoothly with the sidewalls 80*a*, 80*b*.

When the rotating member 24 maintains its phase relationship with respect to the sprocket 11, each control pin 50 rotates as a single unit with the rotating member 24 such that the control pins 50 do not move in the tracks 82 formed by the corresponding holes 80. Accordingly, the drive torque input to the sprocket 11 is transmitted to the output shaft 16 without the control pins 50 moving in the tracks 62, 72 formed by the corresponding holes 60, 70. Accordingly, the output shaft 16 rotates in synchronization with the camshaft 4 while maintaining its phase with respect to the sprocket 11.

When the rotating member 24 rotates toward the advancement side X relative to the sprocket 11, the sidewall 80*b* of the inner wall of each hole 80 presses its corresponding control pin 50 toward the outer side of the track 82. This pressure causes each control pin 50 to pass through the track 82 relatively toward the retardation side Y and move roughly toward the center of the rotation member 24, thus decreasing its radial distance from the rotation centerline 0 (below, simply referred to as "the radial distance"). When this occurs, each control pin 50 pushes toward the advancement side X against the sidewall 60*a* extending along the advancement side X inside the corresponding hole 60, and also pushes toward the retardation side Y against the sidewall 70*b* extending along the retardation side Y inside the corresponding hole 70. This causes each control pin 50 to pass through both the tracks 62, 72 formed by the corresponding holes 60, 70, whereby the output shaft 16 rotates toward the retardation side Y, relative to the sprocket 11.

On the other hand, in the case where the rotating member 24 rotates toward the retardation side Y relative to the sprocket 11, each of the control pins 50 is pressed by the sidewall 80*a* extending along the inner side of the track 82 formed by the inner wall of the corresponding holes 80. This pressure causes each control pin 50 to pass through the track 82 relatively toward the advancement side X, and move roughly toward the outer side of the rotating member 24, thus increasing its radial distance. When this occurs, each control pin 50 presses toward the retardation side Y against the sidewall 60*b* extending along the retardation side Y inside the corresponding holes 60, and also presses toward the advancement side X against the sidewall 70*a* extending along the track 72 formed inside the corresponding holes 70. Accordingly, each control pin 50 passes through both the tracks 62, 72 formed by the corresponding holes 60, 70, and the output shaft 16 rotates toward the advancement side X relative to the sprocket 11.

When the rotating member 24 and the output shaft 16 rotate relative to the sprocket 11 as described above, the smaller the couple of forces generated on the control pins 50 due to the action force from the holes 60, 70, and 80, the better. In the present embodiment, in addition to forming the tracks 82 formed by the holes 80 in the shape of eccentric arcs, the degree of slant of the tracks 62, 72, and 82 formed by the holes 60, 70, and 80 with respect to the radial axis line can be adjusted so as to bring the couple of forces close to 0 at a chosen relative rotational position. Furthermore, in accordance with the present embodiment, the direction traveled by each control pin 50 is approximately a radial direction toward and away from the rotating member 24 to facilitate the setting of the above-mentioned couple of forces. However, the axial line traveled by the control pin 50 may also be set at a slant with respect to this radial direction extending toward and away from the rotating member 24.

As described above, each of the holes 60 constitutes a first hole, and each track 62 formed by each hole 60 constitutes a first track. Further, each of the holes 70 constitutes a second hole, and each track 72 formed by each hole 70 constitutes a second track. Furthermore, each of the holes 80 constitutes a control hole, and each track 82 constituted by each hole 80 constitutes a control track. Moreover, the electric motor 30 and the speed reducer 20 constitute the torque application means, and the control pins 50 and the rotating member 24 constitute the controlling means.

Next, a general explanation regarding overall operations of the valve timing adjustment device 10 will be provided.

(1) When the electricity to the coil 42 is terminated during rotation of the sprocket 11 by the drive torque, the electromagnetic portion 34 ceases to apply torque to the working shaft 33, and the rotating member 24 ceases to rotate relative to the sprocket 11. Therefore, the output shaft 16 ceases to rotate relative to the sprocket 11, and thus the sprocket 11 and the output shaft 16 maintain their phase relationship. This preserves the phase of the camshaft 4 (which rotates in synchronization with the output shaft 16) with respect to the crankshaft.

(2) When the electricity is conducted to the coil 42 during the rotation of the sprocket 11 and the magnetic field rotates around the working axis 33 in the counterclockwise direction as viewed in FIG. 4, this creates the retardation side torque TY on the working shaft 33, which is then transmitted to the rotating shaft 25. Furthermore, the speed reducer 20 increases this retardation side torque TY and changes its directionality toward the advancement side X, and this is then transmitted to the rotating member 24, whereby the rotating member 24 rotates toward the advancement side X relative to the sprocket 11.

Therefore, the radial distance of the control pins 50 decreases, and when this occurs the output shaft 16 rotates toward the retardation side Y relative to the sprocket 11. In other words, since the phase of the output shaft 16 shifts toward the retardation side Y relative to the sprocket 11, the phase of the camshaft 4 also shifts toward the retardation side Y relative to the crankshaft.

(3) When the electricity is conducted into the coil 42 during the rotation of the sprocket 11 to create the magnetic field rotating around the working shaft 33 in the clockwise direction as viewed in FIG. 4, the advancement side torque Tx is created with respect to the working shaft 33, and it is then transmitted to the rotating shaft 25. Furthermore, the speed reducer 20 increases the advancement side torque Tx, and changes its directionality toward the retardation side Y, and transmits it to the rotating member 24, whereby the rotating member 24 rotates toward the retardation side Y relative to the sprocket 11. Therefore, the radial distance of the control pins 50 increases, and as this occurs, the output shaft 16 rotates toward the advancement side X relative to the sprocket 11. In other words, since the phase of the output shaft 16 relative to the sprocket 11 shifts toward the advancement side X, the phase of the camshaft 4 relative to the crankshaft also shifts toward the advancement side X.

According to the valve timing adjustment device 10 explained above, the degree of phase shift of the output shaft 16 relative to the sprocket 11 depends upon the length of the tracks 62, 72 (formed by the holes 60, 70) and the degree by which the tracks 62, 72 slant relative to each other (i.e., the "slant angle" in the present embodiment). The tracks 62, 72 formed by the holes 60, 70 slant with respect to the radial axis line so as to vary their radial distance from the rotation centerline 0. Therefore, depending on the degree to which each track slants, the length of the tracks can be extended or shortened along the direction of rotation, and the degree to which they slant toward each other can be modified. In other words, the length and the relative slant angles of the tracks 62, 72 formed by the holes 60, 70 can be set with relative freedom. Therefore, the present invention increases the level of freedom in setting the degree of phase shift of the output shaft 16 with respect to the sprocket 11, and therefore, the degree of phase shift by the camshaft 4 with respect to the crankshaft as well.

Further, in the valve timing adjustment device 10, the holes 60, 70 forming the linear tracks 62, 72 are easier to form than holes which form non-linear tracks. Moreover, by passing the bar-shaped control pins 50 through the points where the tracks 62, 72 intersect each other, the construction of the valve timing adjustment device 10 is simplified. In the valve timing adjustment device 10, the rolling elements 52, 53 are provided separately to the place where the control pin 50 and the hole 60 are in contact with each other inside the track 62, and to the place where the control pin 50 and the hole 70 are in contact with each other inside the track 72. Therefore, when either the advancement side torque Tx or the retardation side torque TY applied to the working shaft 30 is changed to go in the opposite direction and the direction in which the radial distance of the control pin 50 moves is reversed, the relative rotational direction of the output shaft 16 with respect to the sprocket 11 is also reversed. Note, however, that the main body 51 of the control pin 50 may be configured to contact the inner walls of the holes 60, 70.

Further, in the valve timing adjustment device 10, the track 82 formed by the hole 80 is shaped as an arc, and both ends of the track 82 are roughly perpendicular with respect to the radial axis line of the rotating member 24. Therefore, since there is only a small rate of change in radial distance when the control pin 50 passes the two ends of the track 82, the impact occurring when the control pin 50 reaches the end of the hole 80 is light, and thus noise, damage and the like are prevented.

Figure 10:
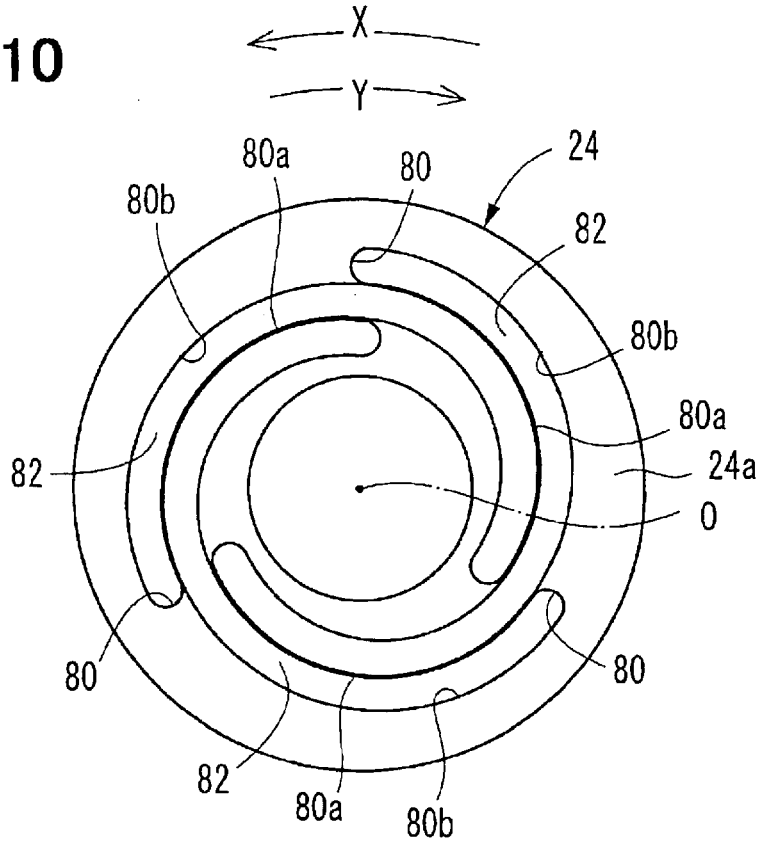
FIG. 10 is a schematic view of a modified example of the valve timing adjustment device according to the first embodiment of the present invention, corresponding to FIG. 8.
Figure 11:
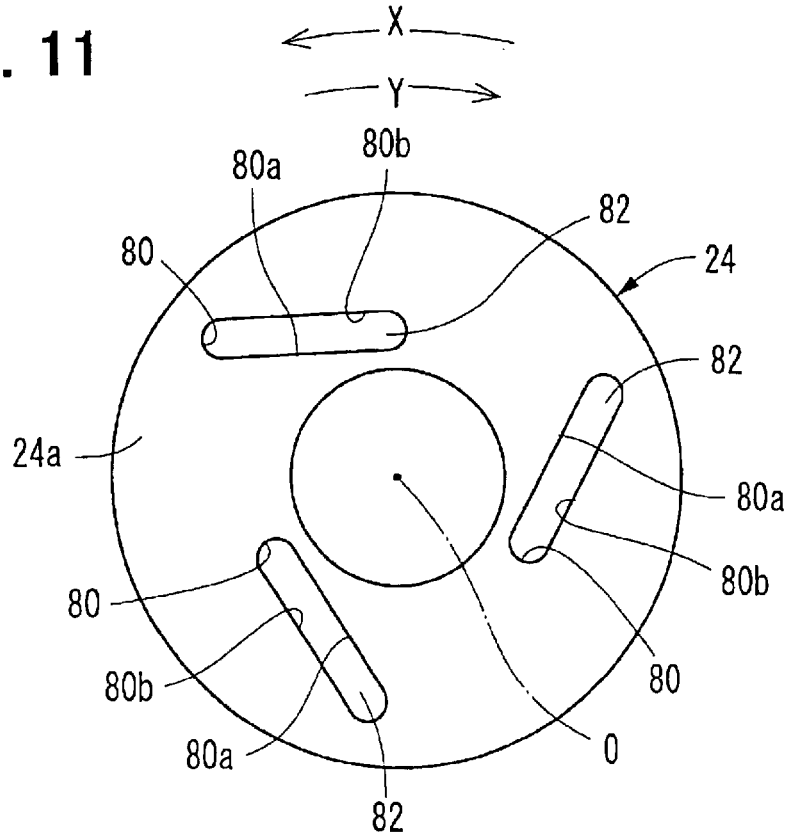
FIG. 11 is a schematic view of another modified example of the valve timing adjustment device according to the first embodiment of the present invention, corresponding to FIG. 8.

Note that, as shown in an alternative example shown in FIG. 10, the track 82 formed by the hole 80 may be extended around the rotation centerline in a spiraling pattern where its rate of curvature changes. When such a pattern is used, both ends of the track 82 may be configured perpendicularly with respect to the radial axis line of the rotating member 24. When the track 82 (formed by the hole 80) is shaped in the spiraling pattern, the couple of forces bearing on the control pin 50 can be brought close to zero. Furthermore, as shown in the modified example shown in FIG. 11, the track 82 formed by the hole 80 may be extended linearly, thus making the holes 80 easier to work on. In such a case, one of the ends of the track 82 may be configured perpendicularly to the radial axis line of the rotating member 24.

Figure 12:
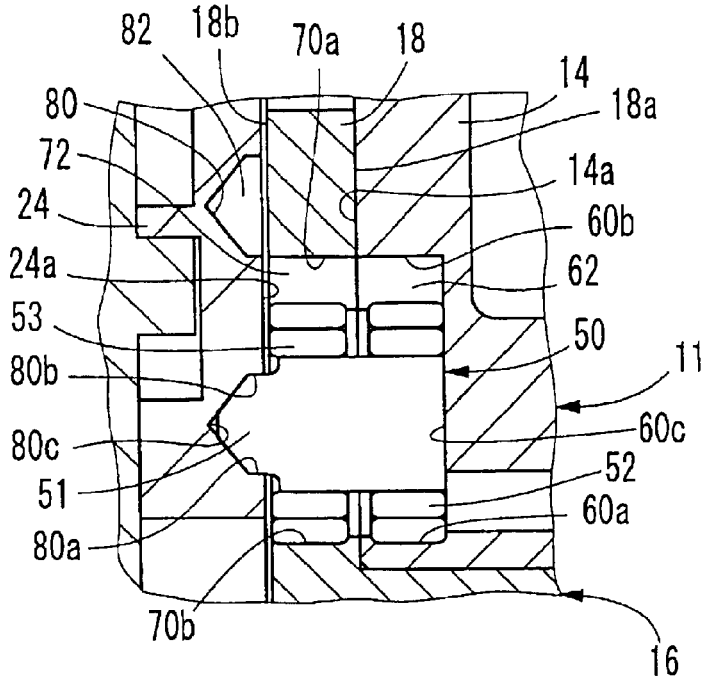
FIG. 12 is an enlarged, cross-sectional view of still another modified example of the valve timing adjustment device according to the first embodiment of the present invention, corresponding to FIG. 7.
Figure 13:
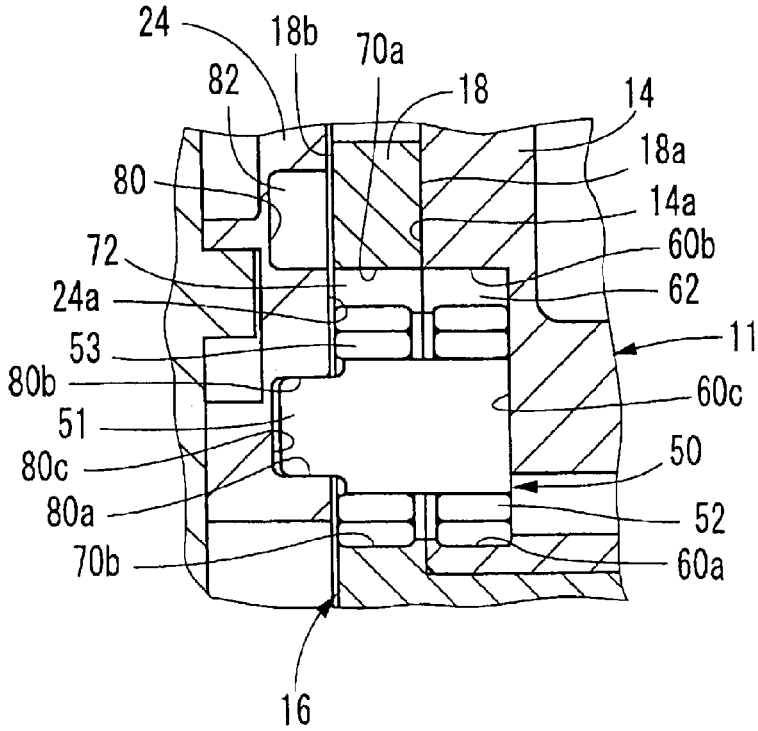
FIG. 13 is an enlarged, cross-sectional view of still another modified example of the valve timing adjustment device according to the first embodiment of the present invention, corresponding to FIG. 7.

In addition, in the valve timing adjustment device 10, the control pins 50 are held between the sprocket 11 and the rotating member 24, and the ball members 54, 56 enable the control pins 50 to roll and make contact with the bottom wall 60*c* of the hole 60 and the bottom wall 80*c* of the hole 80. Therefore, the relative rotation of the rotating member 24 relative to the sprocket 11 occurs smoothly. However, as shown in the modified examples in FIG. 12 and FIG. 13, the pin main body 51 of the control pin 50 may be configured so as to be in direct contact with the bottom walls 60*c*, 80*c* of the holes 60, 80. In such a case, the portion of the pin main body 51, which is in contact with the hole 80, should be formed as cross-sectional shapes to complement the shapes of the sidewalls 80*a*, 80*b*, or, for example, as cross-sectional pentagons as in FIG. 12, or as cross-sectional squares as in FIG. 13, or the like.

In addition, the valve timing adjustment device 10 utilizes the plurality of control pins 50, while a plurality of pairs of holes 60, 70 are provided along the direction of rotation such that each individually corresponds to one of the control pins 50. Additionally, a plurality of holes 80 are provided along the direction of rotation such that each individually corresponds to one of the control pins 50. This configuration alleviates an unbalanced concentration of weight around the rotation centerline 0.

Second Embodiment

Figure 14:
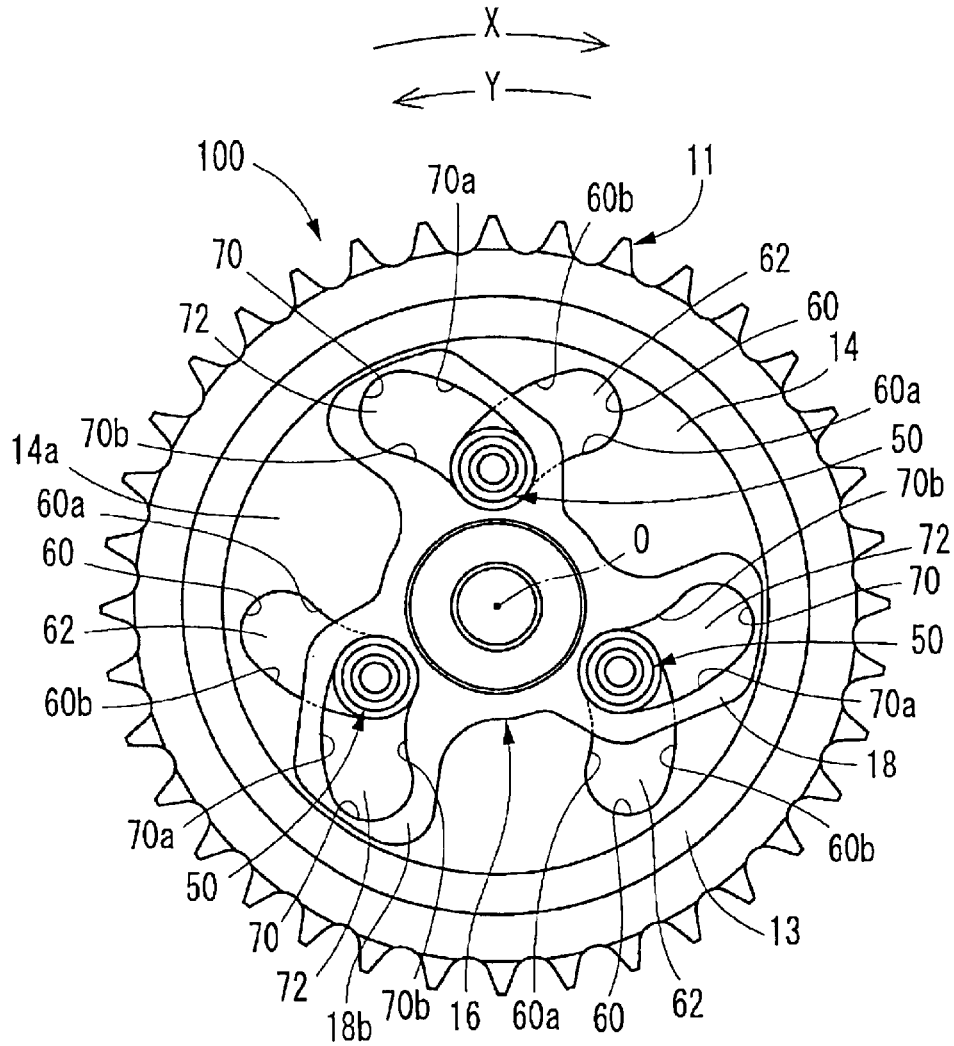
FIG. 14 is a schematic view of a valve timing adjustment device according to a second embodiment of the present invention, corresponding to FIG. 1.

FIG. 14 illustrates a valve timing adjustment device according to a second embodiment of the present invention. The same reference numbers are assigned to those components that are substantially identical to those in the first embodiment. Tracks 62, 72 formed by the holes 60, 70 in the valve timing adjustment device 100 according to the second embodiment differ from those of the first embodiment.

More specifically, the track 62 formed by the hole 60 extends in the shape of an expanded curve outwardly along the radial direction of the conversion portion 14, and slants with respect to the radial axis line toward the advancement side X as it moves away from the rotation centerline 0. The track 72 formed by the hole 70 extends in the shape of an expanded curve outwardly along the radial direction of the conversion portion 18, and slants with respect to the radial axis line toward the retardation side Y as it moves away from the rotation centerline 0.

Note, however, that it is also possible to form the curved tracks 62 such that they slant toward the retardation side Y as they move away from the rotation centerline 0, and form the curved tracks 72 such that they slant toward the advancement side X as they move away from the rotation centerline 0. Also, the tracks 62, 72 may each be shaped as an expanded curve, which expands in a radially inward direction toward the center of the conversion portions 14, 18, and they may also be shaped as wavy lines on both sides of the radial direction, or as a combination of curved lines and straight lines.

Figure 15A:
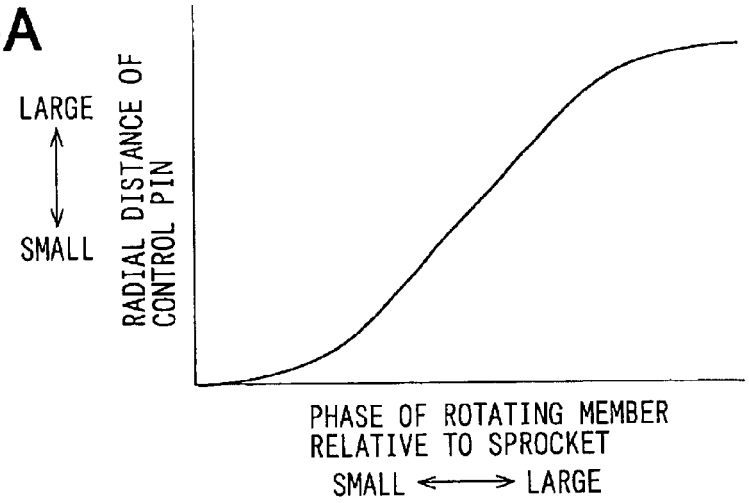
FIGS. 15A–15C are graphs illustrating relationships of the valve timing adjustment device according to the second embodiment of the present invention.
Figure 15B:
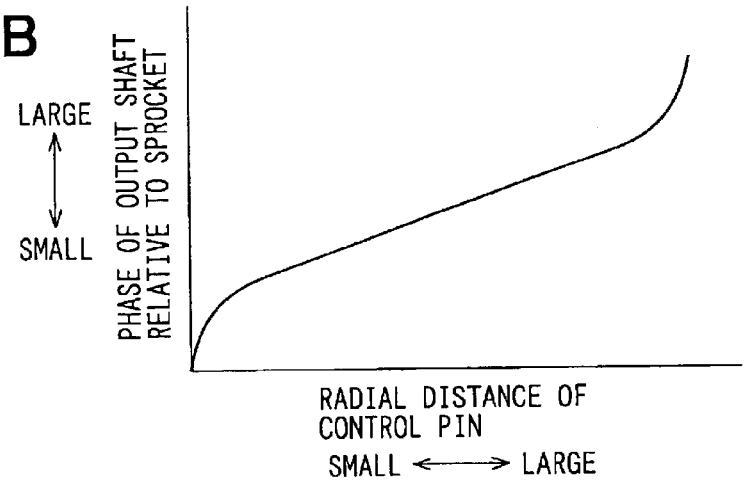
Figure 15C:
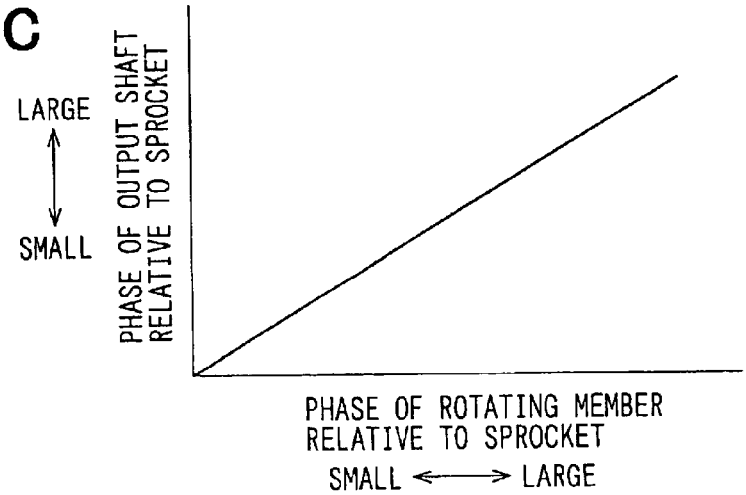

In a case where the track 82 formed by the hole 80 is formed as an off-center arc similar to the first embodiment, the correlation between the phase of the rotating member 24 relative to the sprocket 11, and the radial distance of the control pins 50, will be as shown in FIG. 15(A). When this is adopted in the second embodiment, the curve of the tracks 62, 72 formed by the holes 60, 70 is set so that the correlation between the radial distance of the control pin 50 and the phase of the output shaft 16 with respect to the sprocket 11 will become as shown in FIG. 15(B). By setting the curves in this way, the correlation of the phase of the rotating member 24 with respect to the sprocket 11 and the phase of the output shaft 16 with respect to the sprocket 11 can be a proportional relationship such as shown in FIG. 15(C). This proportional relationship enables accurate and easy control of the rotational phase of the output shaft 16 with respect to the sprocket 11, simply by controlling the torque operation of the electric motor 30.

Figure 16A:
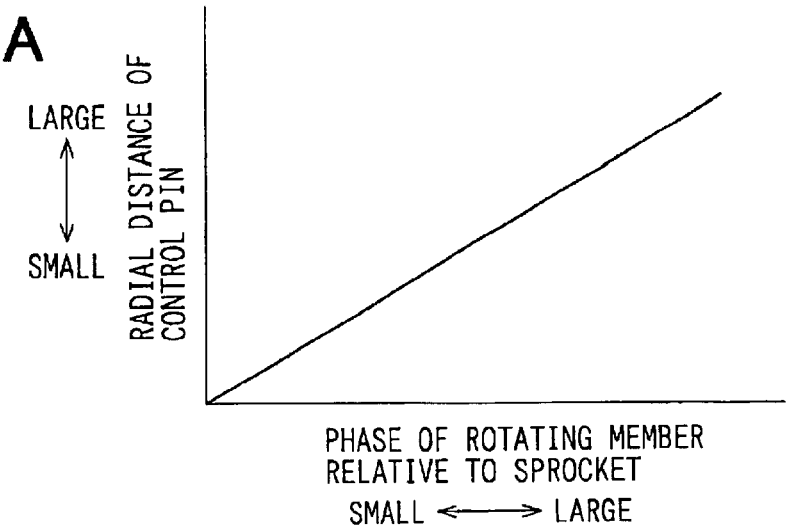
FIGS. 16A–16C are graphs illustrating relationships of a modified example of the valve timing adjustment device according to the second embodiment of the present invention.
Figure 16B:
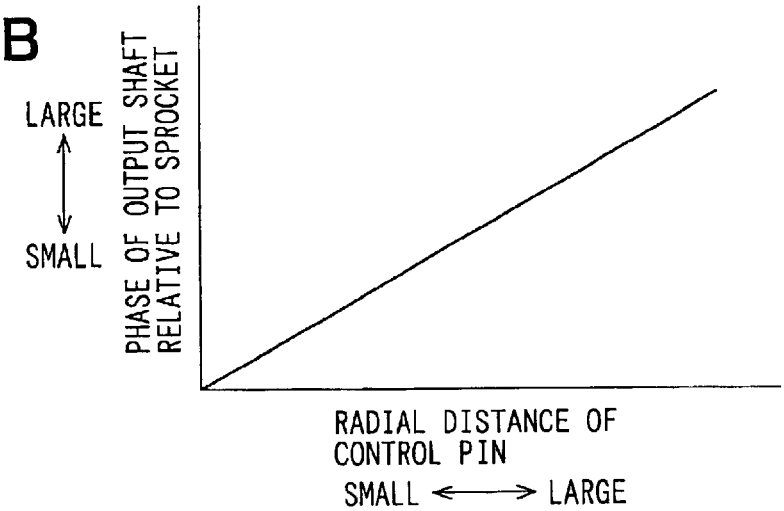
Figure 16C:
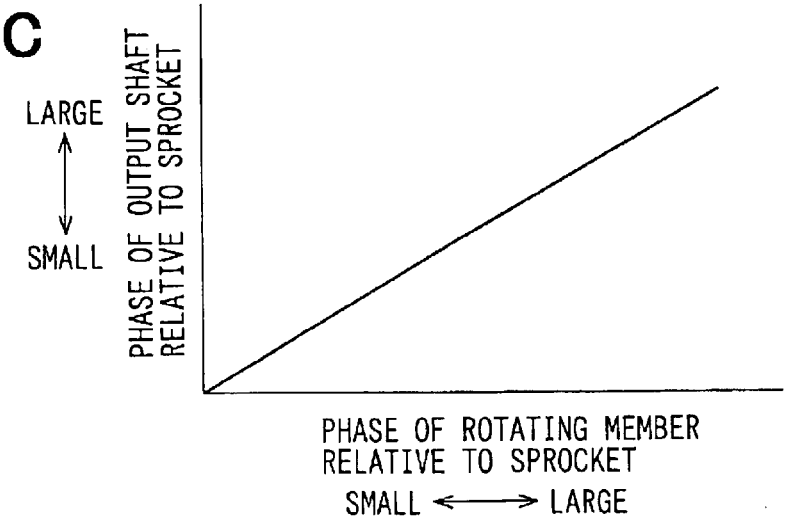

Furthermore, when the spiraling pattern similar to the modified example of the first embodiment shown in FIG. 10 is used in the track 82 formed by the hole 80, the correlation between the phase of the rotating member 24 with respect to the sprocket 11, and the radial distance of the control pins 50, becomes a proportional relationship, such as shown in FIG. 16(A), for example. When this pattern is used in the second embodiment, the curve of the tracks 62, 72 formed by the holes 60, 70 is set such that the correlation between the radial distance of the control pins 50, and the phase of the output shaft 16 with respect to the sprocket 11, becomes a proportional relationship as shown in FIG. 16(B). By adopting this setting, the correlation between the phase of the rotating member 24 with respect to the sprocket 11, and the phase of the output shaft 16 with respect to the sprocket 11, can be a proportional relationship such as shown in FIG. 16(C). This proportional relationship enables accurate and easy control of the rotational phase of the output shaft 16 with respect to the sprocket 11, achieved simply by controlling the torque operation of the electric motor 30.

Third Embodiment

Figure 17:
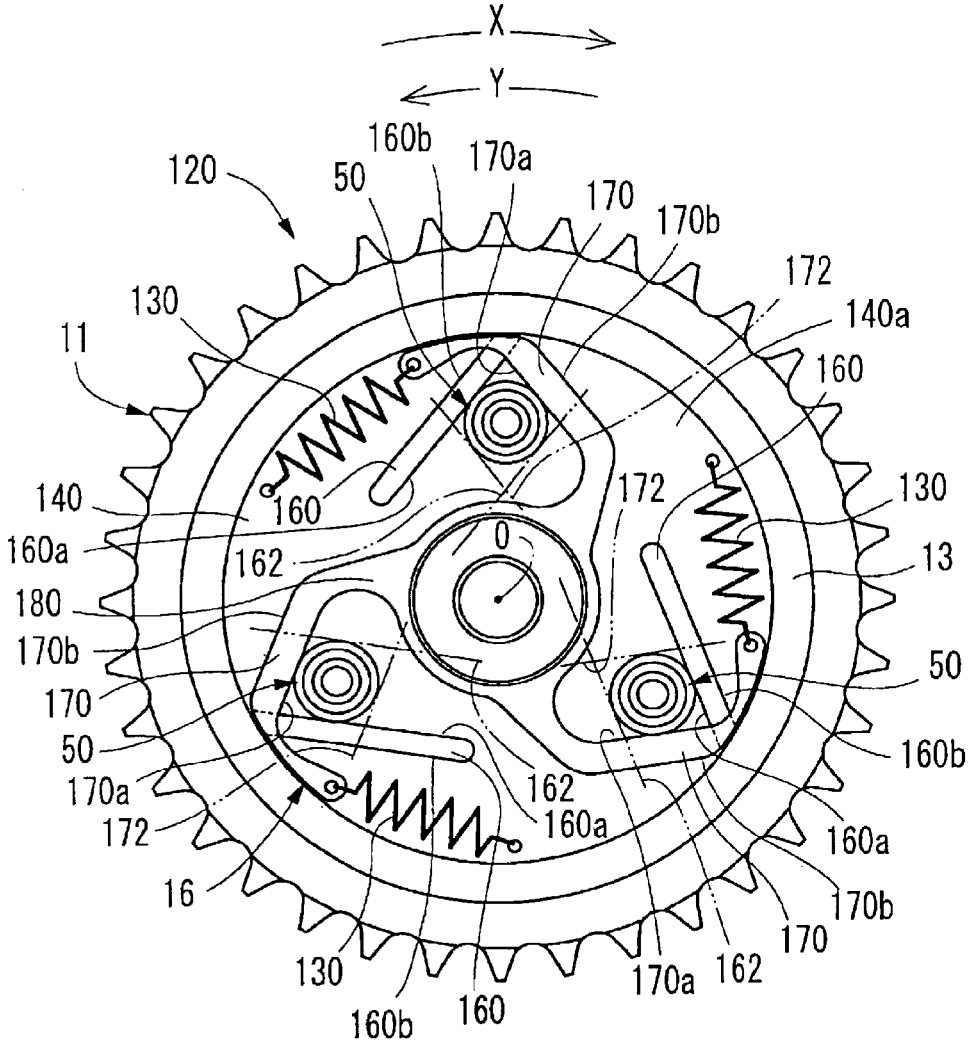
FIG. 17 is a schematic view of a valve timing adjustment device according to a third embodiment, corresponding to FIG. 1.
Figure 18:
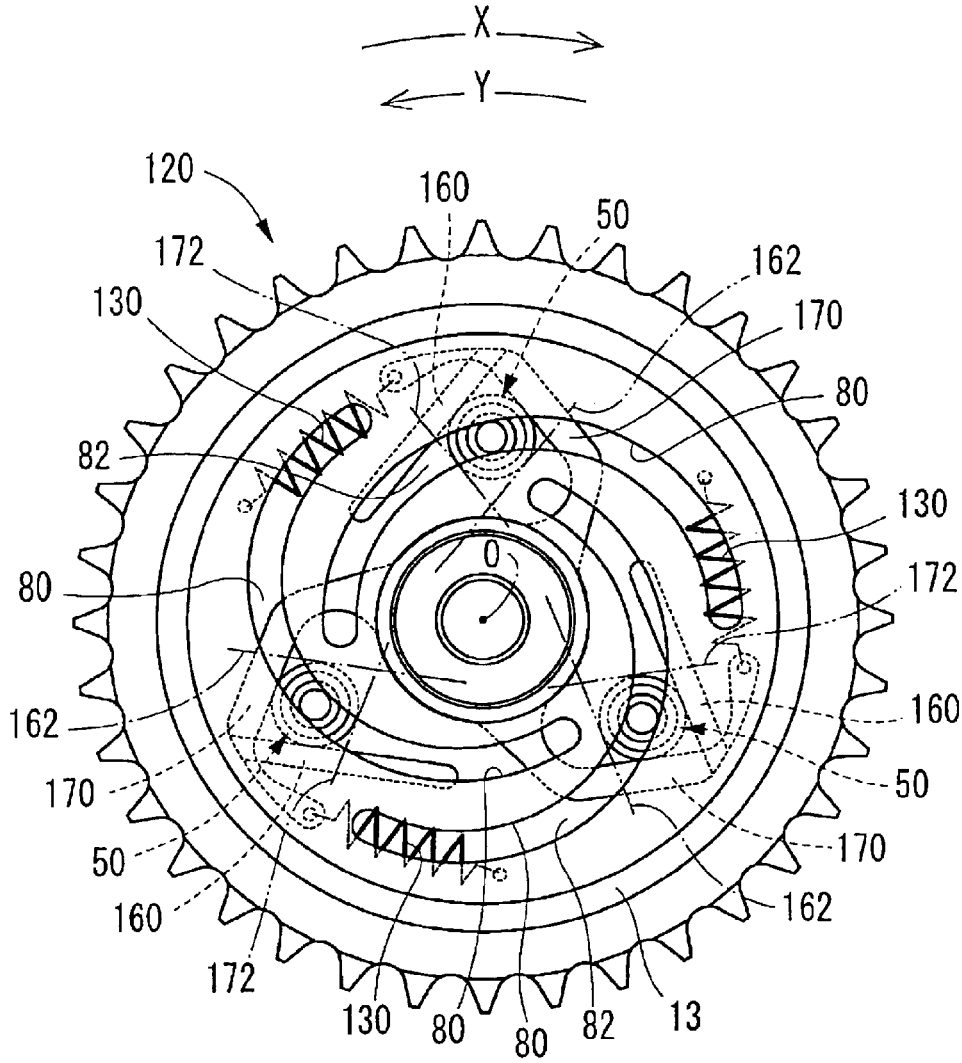
FIG. 18 is a schematic view of the valve timing adjustment device according to the third embodiment of the present invention, corresponding to FIG. 9.

FIG. 17 and FIG. 18 show a valve timing adjustment device according to a third embodiment of the present invention. The same reference numbers are assigned to components that are substantially similar to those in the first embodiment.

In addition to the constructions in the first embodiment, a valve timing adjustment device 120 according to the third embodiment further includes a spring 130, and instead of the holes 60, 70 included in the first embodiment, the valve timing adjustment device 120 has wall portions 160, 170. These wall portions 160, 170 are provided to conversion portions 140, 180, respectively, which correspond to the conversion portions 14, 18 in the first embodiment.

More specifically, the conversion portion 140 is formed as a round disk similar to the conversion portion 14 in the first embodiment. The wall portions 160 are provided to three locations on the conversion portion 140, and are formed such that if one of the wall portions 160 were rotated 120° around the rotation centerline 0, it would overlap with another. Each of the wall portions 160 is provided perpendicular to an inner wall 140*a* of the conversion portion 140 facing opposite to the conversion portion 180. As indicated by the dotted lines, each of the wall portions 160 forms a track 162 along a sidewall 160*a* facing toward the advancement side X. These tracks 162 correspond to the tracks 62 in the first embodiment. The tracks 162 formed by the wall portions 160 slant with respect to the radial axis line of the conversion portion 140, in such a way as to vary their radial distance from the rotation centerline 0. In the present embodiment, each track 162 formed by each wall 160 extends in a straight line along the flat sidewall 160*a*, and slants relative to the radial axis line as it moves away from the rotation centerline 0.

In the conversion portion 180, the portion forming the sidewall 70*b* of each hole 70 in the conversion portion 18 in the first embodiment is eliminated. The holes 70 open toward the outward edge of the conversion portion 18. In the conversion portion 180, the three wall portions 170 are formed at the respective locations forming the outer walls 70*a* of the holes 70 in the first embodiment. In other words, in the conversion portion 180, the wall portions 170 are provided at three locations facing the wall portions 160 in such a way that if one of the wall portions 170 were rotated 120° around the rotation centerline 0 it would overlap with another. Each wall portion 170 is formed perpendicularly to the outer wall of the conversion portion 180, facing opposite to the conversion portion 140 and the rotating member 24. As shown by the chain double-dashed lines in FIG. 17 and FIG. 18, each wall portion 170 forms a track 172 along the sidewall 170*a* facing the retardation side Y. These tracks 172 correspond to the tracks 72 in the first embodiment. The tracks 172 formed by the wall portions 170 slant with respect to the radial axis line of the conversion portion 180 so as to vary their radial distance from the rotation centerline 0.

In the present embodiment, the tracks 172 formed by the wall portions 170 extend linearly along the flat sidewalls 170*a*, and slant toward the retardation side Y with respect to the radial axis line as they move away from the rotation centerline 0. According to this configuration, the tracks 172 formed by the wall portions 170 and the tracks 160 formed by their facing wall portions 160 intersect each other at locations determined by the rotational phase of the output shaft 16 with respect to the sprocket 11 and slant with each other toward the rotational direction, as shown in FIG. 17.

Note, however, it is also possible to adopt a configuration in which either the tracks 162 formed by the wall portions 160 along the sidewalls 160*a*, or the tracks 172 formed by the wall portions 170 along the sidewalls 17*a*, are formed with no slant with respect to the radial axis line. Furthermore, the tracks 162 formed by the wall portions 160 may slant with respect to the radial axis line toward the retardation side Y as they move away from the rotation centerline 0, and the tracks 172 formed by the wall portions 170 may be formed such that they slant with respect to the radial axis line toward the advancement side X as they move away from the rotation centerline 0.

The three control pins 50 are arranged so that they correspond to each of the three pairs of walls 160, 170 which face each other. Each control pin 50 is held between the conversion portion 140 and the rotating member 24 such that the control pin 50 can pass through the point where the tracks 162, 172 formed by the corresponding walls 160, 170 intersect each other. The wall portions 160 make contact with the control pins 50 inside the tracks 162 at the sidewalls 160*a*, which are on the retardation sides Y of the tracks 162. The wall portions 170 make contact with the control pins 50 inside the tracks 172 at the sidewalls 170*a*, which are on the advancement side X of the tracks 172. Each control pin 50 has the rolling element 52 at the point where the control pin 50 is in contact with the wall portion 160, and also has the rolling element 53 at the point where the control pin 50 is in contact with the wall portion 170. Each control pin 50 makes further contact with the inside wall 140*a* of the conversion portion 140 by means of the ball portion 54.

As described above, each wall portion 160 constitutes a first wall portion, and each track 162 formed by the wall portion 160 constitutes the first track. Furthermore, each wall portion 170 constitutes a second wall portion, and each track 172 formed by the wall portion 170 constitutes the second track.

The spring 130 serving as an energizing means is constituted of an extension coil spring, and three of these springs 130 are provided to stretch from the conversion portion 140 and the conversion portion 180. One end of each spring 130 is mounted to the conversion portion 140 at equidistant positions around the rotation centerline 0. The other end of each spring 130 is mounted to the conversion portion 180 at equidistant positions around the rotation centerline 0, corresponding to locations near the three apexes of the roughly triangular conversion portion 180. Each spring 130 energizes the sprocket 11 toward the advancement side X, and energizes the output shaft toward the retardation side Y. This energization holds each of the control pins 50 to its corresponding wall portions 160, 170.

Note, however, in addition to the above-mentioned extension coil spring, the spring 130 can also be a compressed coil spring or a torsion spring or the like. Furthermore, the track 162 and the track 172 may also be formed by the wall portion 160*b* that faces the retardation side Y of the wall portion 160, and the wall portion 170*b* that faces the advancement side X of the wall portion 170. In this case, the portions making contact with the control pin 50 will be the wall portion 160*b* on the advancement side X of the track 162, and the wall portion 170*b* on the retardation side Y of the track 172. In such a case, the sprocket 11 will be energized toward the retardation side Y, and the output shaft 16 will be energized toward the advancement side X.

In the valve timing adjustment device 120, when the electromagnetic portion 34 applies the retardation side torque TY to the working shaft 33, the same principle applies as in the first embodiment. Therefore, the rotating member 24 rotates toward the advancement side X relative to the sprocket 11, and the radial distance of each of the control pins 50 decreases. When this occurs in the present embodiment, the energization by the spring 130 causes the sidewall 160*a* of each of the wall portions 160 to be pressed toward the control pin 50 on the advancement side X, and the sidewall 170*b* of each wall portion 170 is pressed toward the control pin 50 on the retardation side Y. As a result, each of the control pins 50 passes through both the tracks 162, 172 formed by the corresponding wall portions 160, 170, and the output shaft 16 rotates toward the retardation side Y relative to the sprocket 11.

On the other hand, when the electromagnetic portion 34 applies the advancement side torque Tx to the working shaft 33, the same principle applies as in the first embodiment. Therefore, the rotating member 24 rotates toward the retardation side Y relative to the sprocket 11, and the radial distances of the control pins 50 increase. When this occurs, the control pins 50 press the sidewalls 160*a* of the corresponding wall portions 160 toward the retardation side Y, and the side portions 170*a* of the corresponding wall portions 170 are pressed toward the advancement side X. As a result, the control pins 50 pass through both the tracks 162, 172 formed by the corresponding wall portions 160, 170, and the output shaft 16 rotates toward the advancement side X relative to the sprocket 11.

In accordance with the valve timing adjustment device 120 described above, the degree of phase shift by the output shaft 16 relative to the sprocket 11 depends on the length of the tracks 162, 172 formed by the wall portions 160, 170 and the degree by which they slant with respect to each other (the "slant angle" in the present embodiment). The tracks 162, 172 formed by the wall portions 160, 170 are formed at slant angles with respect to the radial axis line, so that the radial distance of each track 162, 172 from the rotation centerline 0 varies.

Therefore, the length of the tracks 162, 172 can be extended or shortened along the direction of rotation depending on each track's individual slant angle. Their relative slant angles can also be altered. In other words, the length and relative slant angles of the tracks 162, 172 formed by the wall portions 160, 170 can be set with relative freedom. This construction increases the amount of freedom in setting the degree of phase shift to be exhibited by the output shaft 16 with respect to the sprocket 11, and therefore, the degree of phase shift to be exhibited by the camshaft 5 with respect to the crankshaft.

Furthermore, the wall portions 160, 170 forming the linearly shaped tracks 162, 172 in the valve timing adjustment device 120 are easier to work on than wall portions forming non-linear tracks. Note, however, that the sidewalls 160*a*, 170*a* of the wall portions 160, 170 are curved. Therefore, it is possible to form the tracks 162 in an expanded curved shape toward the outer side or toward the inner side along the radial direction of the conversion portion 140 along the curved sidewalls 160*a*, and the tracks 172 can be formed in an expanded curved shape toward the outer side or the inner side along the radial direction of the conversion portion 180 along the curved sidewall 170*a*. When using the expanded curved tracks 162, 172 mentioned above, the same effect can be obtained as in the second embodiment. Additionally, the tracks 162, 172 can also be shaped as wavy curved lines on both sides along the radial direction, or as a combination of curved and straight lines.

Further, the valve timing adjustment device 120 uses a simple construction in which the bar-shaped control pins 50 pass through the points where the tracks 162, 172 formed by the wall portions 160, 170 intersect each other. Moreover, the valve timing adjustment device 120 is provided with rolling elements 52, 53 provided individually to the points where the control pins 50 inside the tracks 162 make contact with the wall portions 160, and the control pins 50 inside the tracks 172 make contact with the wall portions 170. Therefore, when the direction along which the control pins 50 vary their radial distances is reversed, the relative rotational direction of the output shaft 16 with respect to the sprocket 11 is smoothly reversed.

Also, in the valve timing adjustment device 120, the ball members 54, 56 enable the control pins 50 to roll and make contact with the inner wall 140*a* of the conversion portion 140 and the bottom wall 80*c* of the hole portion 80. Accordingly, the rotating member 24 can rotate smoothly relative to the sprocket 11. Note, however, that the pin main body 51 of each control pin 50 may also be constructed so as to make direct contact with the inner wall 140*a* of the conversion portion 140.

The valve timing adjustment device 120 uses a plurality of control pins 50, and a plurality of pairs of wall portions 160, 170 individually corresponding to each of the control pins 50 are arranged along the direction of rotation, thereby alleviating unbalanced distribution of weight around the rotation centerline 0.

Fourth Embodiment

Figure 19:
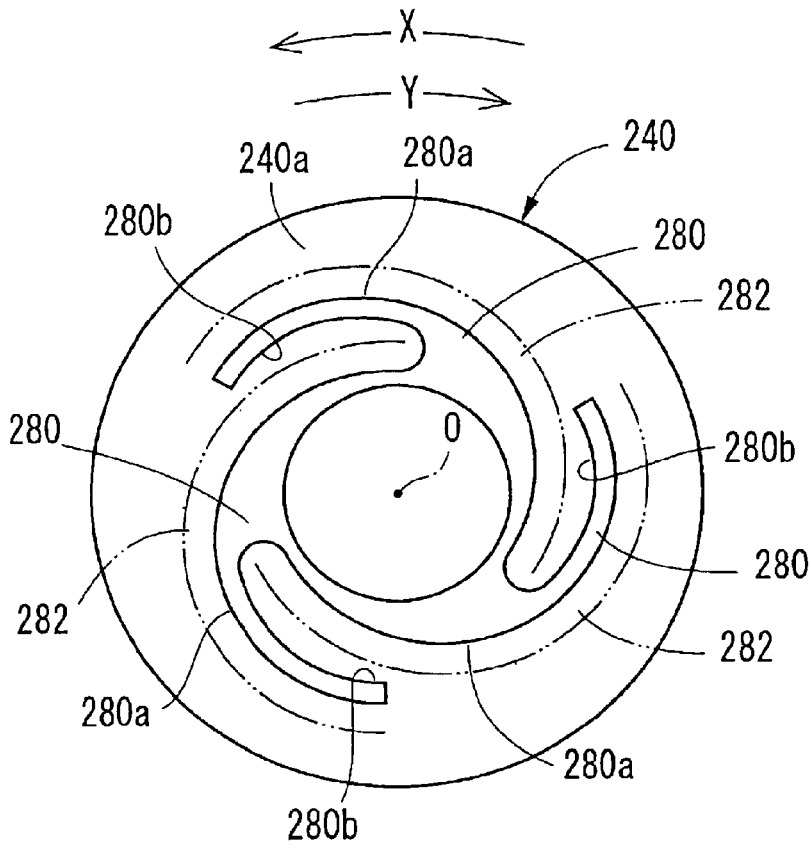
FIG. 19 is a schematic view of a rotating member of a valve timing adjustment device according to a fourth embodiment of the present invention, corresponding to FIG. 8.
Figure 20:
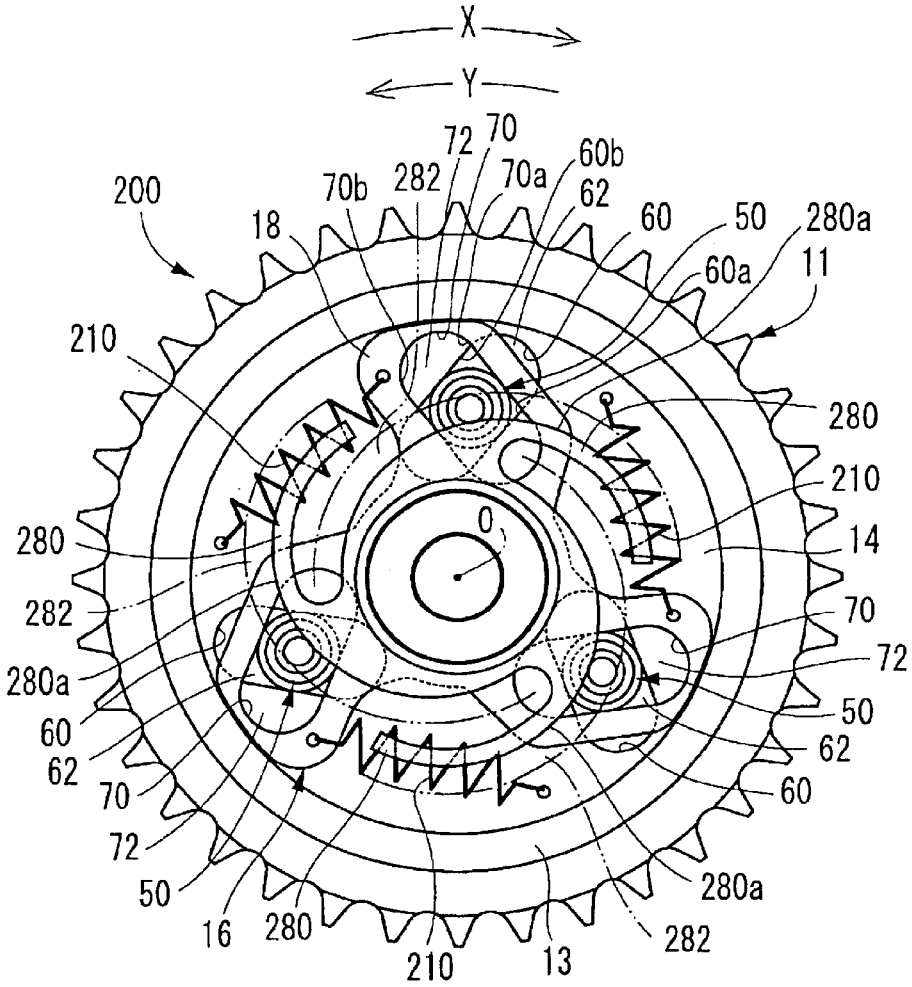
FIG. 20 is a schematic view of the valve timing adjustment device according to the fourth embodiment of the present invention, corresponding to FIG. 9.

FIG. 19 and FIG. 20 show a valve timing adjustment device according to a fourth embodiment of the present invention. The same reference numbers are assigned to components, which are substantially similar to those in the first embodiment.

In addition to the constructions in the first embodiment, the valve timing adjustment device 200 according to the fourth embodiment also has a spring 210, and instead of having the holes 80 in the first embodiment, wall portions 280 are provided to a rotating member 240. (This rotating member 240 corresponds to the rotating member 24 in the first embodiment.)

More specifically, except for having the wall portions 280, the rotating member 240 is constructed similarly to the rotating member 24. The wall portions 280 are provided to three locations on the rotating member 240, being formed such that if one were rotated 120° around the rotation centerline 0, it would overlap with another. Each wall portion 280 is provided perpendicularly to an outer wall 240*a* of the rotating member 240 facing the conversion portion 18. As shown by the chain double-dashed lines in FIG. 19 and FIG. 20, each wall portion 280 is formed so as to run along the sidewall 280*a* facing radially outward, thus forming tracks 282 corresponding to the tracks 82 in the first embodiment. The tracks 282 formed by the wall portions 280 slants with respect to the radial axis line of the rotating member 240 so as to vary its radial distance from the rotation centerline 0. In the present embodiment, the tracks 282 formed by the wall portions 280 extend along the curved arc-shaped sidewalls 280*a* which are off-center from the rotation centerline 0, and the tracks 282 slant with respect to the radial axis line toward the advancement side X as they move away from the rotation centerline 0. Particularly as shown in FIG. 20, the tracks 282 formed by the wall portions 280 are arranged so as to intersect with one of the pairs of tracks 62, 72 formed by the holes 60, 70.

Note, however, that the tracks 282 formed by the wall portions 280 may also slant with respect to the radial axis line toward the retardation side Y as they move away from the rotation centerline 0.

The ball member 56 of one of the control pins 50 passes through each of the tracks 282 formed by the wall portions 280. The wall portions 280 make contact with the control pins 50 inside the tracks 282 at the sidewalls 280*a*, which are on the inner side along the radial direction of the tracks 282. The ball members 56 enable the control pins 50 to also make contact with the outer wall 240*a* of the rotating member 240.

Note, however, that the tracks 282 formed by the wall portions 280 do not have to be extended in the off-center arc-shaped pattern. They may also extend in the spiraling pattern, or may also extend as straight lines so as to increase the workability of the wall portions 280. In the case where the tracks 282 formed by the walls 280 are shaped in the off-center arc-shaped pattern or in the spiraling pattern, the couple of forces bearing on the control pins 50 can be brought close to zero, as in the first embodiment.

As described above, the respective wall portions 280 constitute control wall portions, and the respective tracks 282 formed by the wall portions 280 constituted control tracks.

As shown in FIG. 20, the springs 210 are constituted of extension coil springs, and three of these are provided and stretch across from the conversion portion 14 to the conversion portion 18. One end of each of the springs 210 is mounted at equidistant locations on the conversion portion 14 around the rotation centerline 0. The other ends of the springs 210 are mounted at equidistant locations around the rotation centerline 0 which corresponds to the three apexes of the roughly triangular conversion portion 18. Each spring 210 energizes the sprocket 11 toward the advancement side X, and the output shaft 16 toward the retardation side Y. Such energization causes the control pins 50 to be pressed between the sidewalls 60*b* of the corresponding holes 60 and the sidewalls 70*a* of the corresponding holes 70, thus being energized toward the radially inward side.

As described above, the springs 210 and the holes 60, 70 constitute supplementary energizing means. The supplementary energizing means together with the electric motor 30 and the speed reducer 20 constitute a torque application means. The torque application means together with the control pins 50 and the rotating member 240 constitute a controlling means.

Note, however, that the springs do not have to be the above-mentioned extension coil springs. For example, it is also possible to use a compressed coil spring or a torsion spring or the like. Furthermore, the wall portions 280 may form the tracks 282 with their sidewalls 280*b* which face radially inward, and may be configured such that the sidewalls 28*b* which face radially outwardly make contact with the control pin 50 inside the track 282. Such a structure constitutes a device 200 for energizing the control pins 50 toward the radially outward direction.

In the valve timing adjustment device 200, when the electromagnetic portion 34 applies retardation side torque TY to the working shaft 33, the same principle applies as in the first embodiment; therefore, the rotating member 24 rotates toward the advancement side X relative to the sprocket 11. Therefore, in the present embodiment, the energization of the springs 210 presses the control pins 50 corresponding to each of the sidewalls 60*b*, 70*b* of each of the holes 60, 70, thus energizing the control pins 50 toward the radially inward direction. This inward energization causes the control pins 50 to be pressed toward the sidewalls 280*a* of the corresponding wall portions 280. This also causes the control pins 50 to pass through the tracks 282 formed by the corresponding wall portions 280 relatively toward the retardation side Y so as to move toward the center of the rotating member 240, thus decreasing the radial distances of the control pins 50. When this occurs, each of the control pins 50 pushes the sidewalls 60*a*, 70*b* of the corresponding holes 60, 70 toward the advancement side X and the retardation side Y, respectively, as in the first embodiment. This causes the output shaft 16 to rotate toward the retardation side Y relative to the sprocket 11.

On the other hand, when the electromagnetic portion 34 applies the advancement side torque Tx to the working shaft 33, the same principle applies as in the first embodiment; therefore, the rotating member 24 rotates toward the retardation side Y relative to the sprocket 11. Therefore, in the present embodiment, the sidewalls 280*a* of the corresponding wall portions 280 press on the control pins 50. This pressure on the control pins 50 causes the control pins 50 to pass through the tracks 282 formed by the corresponding wall portions 280, relatively toward the advancement side X, so as to move roughly away from the center of the rotating member 240, thus increasing the radial distance of the control pins 50. When this occurs, the control pins 50 press on the sidewalls 60*b*, 70*a* of the corresponding hole portions 60, 70 toward the retardation side Y and the advancement side X, respectively, as in the first embodiment. Therefore, the output shaft 16 rotates toward the advancement side X relative to the sprocket 11.

According to the valve timing adjustment device 200 described above, ball members 54, 56 enable the control pins 50 to roll and make contact with the bottom walls 60*c* of the holes 60 and the outer wall 240*a* of the rotating member 240. Therefore, the relative rotation of the rotating member 240 with respect to the sprocket 11 occurs smoothly. Note, however, that the pin main body 51 of each control pin 50 may also be configured so as to make direct contact with the outer wall 240*a* of the rotating member 240.

Furthermore, according to the valve timing adjustment device 200, the plurality of wall portions 280, which the plurality of control pins 50 correspond to, are provided around the rotational direction. This configuration alleviates unbalanced weight distribution around the rotation centerline 0.

Fifth Embodiment

Figure 21:
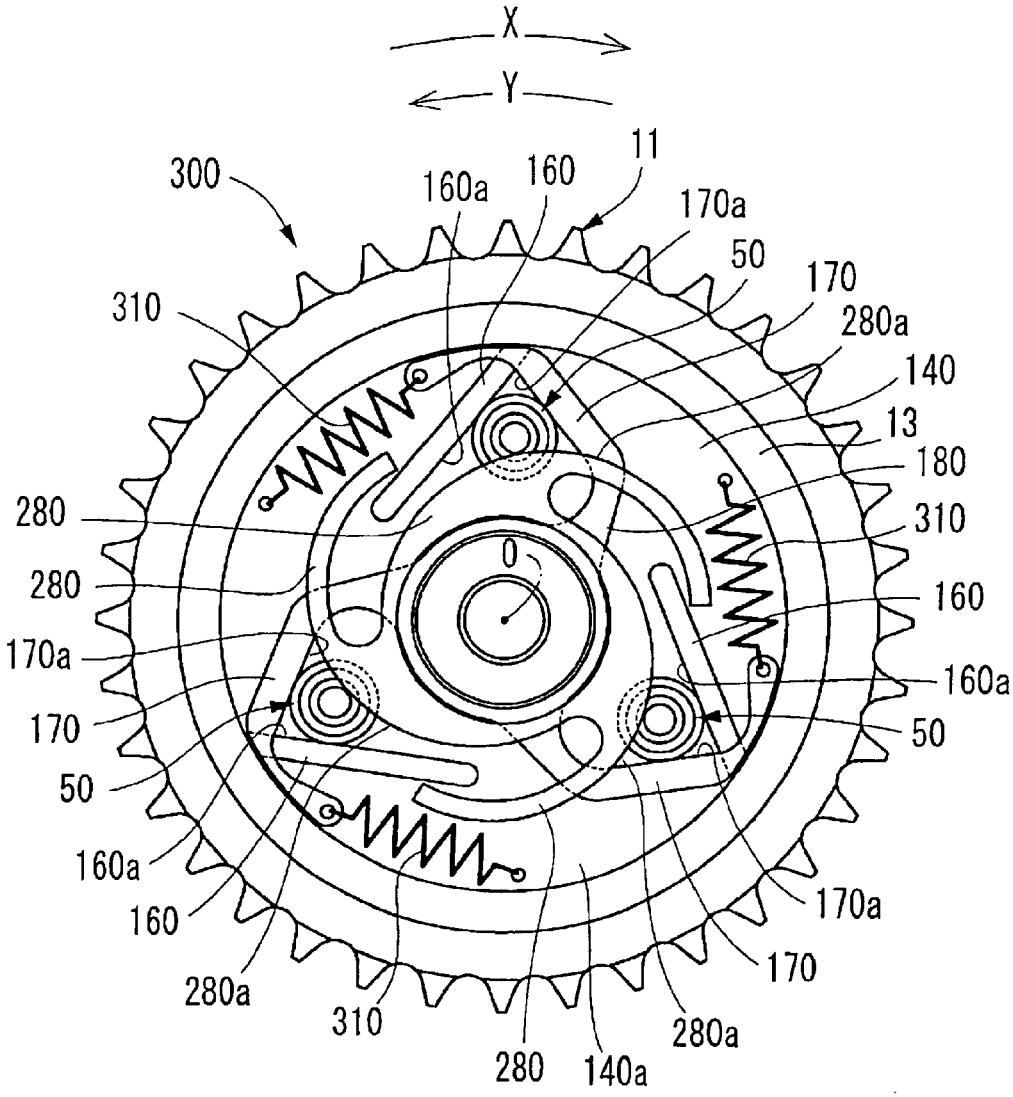
FIG. 21 is a schematic view of a valve timing adjustment device according to a fifth embodiment of the present invention, corresponding to FIG. 9.

FIG. 21 shows a valve timing adjustment device according to a fifth embodiment of the present invention. The same reference numbers are applied to those components that are substantially similar to those in the first embodiment.

The valve timing adjustment device 300 according to the fifth embodiment is constructed by combining desirable elements of the third embodiment with desirable elements of the fourth embodiment. Specifically, in the valve timing adjustment device 300, the conversion portions 140, 180 having the wall portions 160, 170 of the third embodiment are provided to the sprocket 11 and the output shaft 16, respectively, and the rotating member 240 having the wall portion 280 of the fourth embodiment is also used. However, the slant of the tracks 282 formed by the wall portions 280 relative to the radial axis line is set so as to intersect with any one of the pairs the tracks 162, 172 formed by the wall portions 160, 170.

In addition, in the valve timing adjustment device 300, three springs 310 corresponding to the springs 130 in the third embodiment are also employed, and these springs 310 function similarly to the springs 210 in the fourth embodiment. However, the springs 310 energize the sprocket 11 and the output shaft 16 toward the advancement side X and toward the retardation side Y, respectively. This energization causes the pins 50 to be held between the sidewalls 160*a* of the corresponding wall portions 160 and the sidewalls 170*a* of the corresponding wall portions 170.

As described above, the springs 310 constitute the energizing means. The springs 310 and the wall portions 160, 170 constitute the supplementary energizing means. The supplementary energizing means along with the electric motor 30 and the speed reducer 30 constitute the torque application means, and the torque application means along with the control pins 50 and the rotating member 240 constitute the controlling means.

According to the valve timing adjustment device 300 as described above, when the electromagnetic portion 34 applies the retardation side torque TY to the working axis 33, the same principle applies as in the first embodiment; therefore, the rotating member 24 rotates toward the advancement side X relative to the sprocket 11. When this occurs, the energization by the springs 310 presses the control pins 50 against the sidewalls 160*a*, 170*a* of the corresponding wall portions 160, 170, and energizes the control pins 50 radially inward. This energization causes the control pins 50 to be pressed toward the sidewalls 280*a* of the corresponding wall portions 280, whereby the radial distances of the control pins 50 decrease. When this occurs, the energization by the springs 310 causes the sidewalls 160*a* of the wall portions 160 to be pressed against the control pins 50 on the advancement side X, and also causes the sidewalls 170*a* of the wall portions 170 to press against the control pins 50 on the retardation side Y. As a result, the output shaft 16 rotates toward the retardation side Y relative to the sprocket 11.

On the other hand, when the electromagnetic portion 34 applies the advancement side torque Tx to the working shaft 33, the same principle applies as in the first embodiment; therefore, the rotating member 24 rotates toward the retardation side Y relative to the sprocket 11. Therefore, each of the control pins 50 is pressed by the sidewalls 280*a* of the corresponding wall portions 280 similar to the fourth embodiment, and thus their radial distance increases. When this occurs, the sidewalls 160*a*, 170*a* of the corresponding wall portions 160, 170 are pressed by the control pins 50 toward the retardation side Y and toward the advancement side X, respectively, just as in the third embodiment. Therefore, the output shaft 16 rotates toward the advancement side X relative to the sprocket 11.

According to the valve timing adjustment device 300 explained above, similar effects can be obtained as in both, the third embodiment and the fourth embodiment.

Sixth Embodiment

Figure 22:
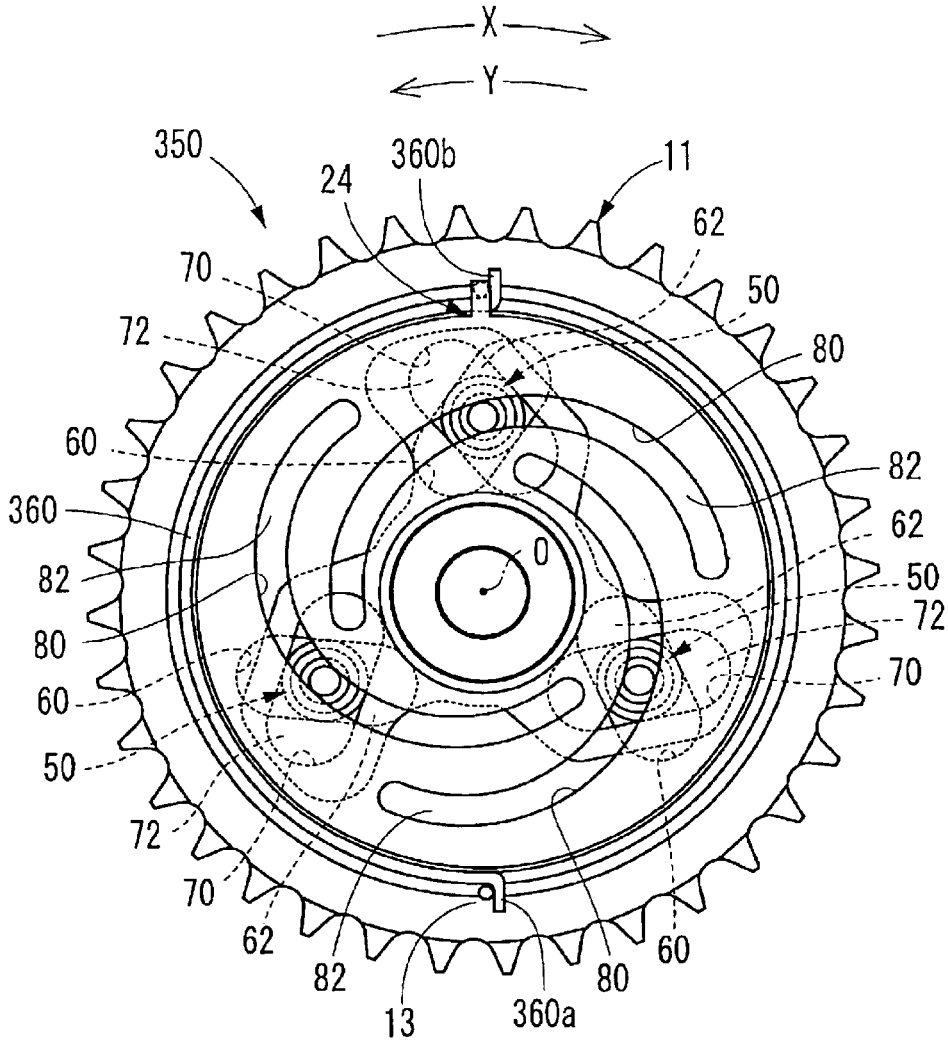
FIG. 22 is a schematic view of a valve timing adjustment device according to a sixth embodiment of the present invention, corresponding to FIG. 9.

FIG. 22 shows a valve timing adjustment device according to a sixth embodiment of the present invention. The same reference numbers are applied to those components that are substantially similar to those in the first embodiment. In addition to the constructions in the first embodiment, the valve timing adjustment device 350 according to the sixth embodiment further comprises springs 360.

The springs 360 are torsion springs. One end 360*a* of each of the springs 360 is mounted to the input cylinder 13 of the sprocket 11, and the other end 360*b* is mounted to the rotating member 24. The springs 360 energize the sprocket 11 toward the advancement side X, and energize the rotating member 24 toward the retardation side Y. Further, as the rotating member 24 rotates toward the advancement side X, relative to the sprocket 11, the force of the energization applied by the springs 360 to the sprocket 11 and to the rotating member 24 increases. Note, however, that the springs 260 do not have to be torsion springs. For example, extension coil springs and compressed coil springs and the like may also be used.

In accordance with the above-mentioned valve timing adjustment device 350, immediately after the engine is started or stopped, for example, or at other times when the electromagnetic portion 34 is not applying torque to the working shaft 33, the energization by the springs 360 causes the rotating member 24 to maintain its phase relative to the sprocket 11. Therefore, by extension, the phase of the camshaft 4 with respect to the crankshaft is also maintained. Therefore, immediately after the engine starts, or when it is stopped, the phase of the camshaft 4 with respect to the crankshaft can quickly be brought to its optimum phase.

As described above, the spring 360 constitutes a holding means. The holding means along with the electric motor 30 and the speed reducer 20 constitute the torque application means. The torque application means along with the control pin 50 and the rotating member 24 constitute the controlling means. Each of the embodiments described above is formed having three sets of tracks, including the tracks 62 or 162 serving as the first tracks, the tracks 72 or 172 serving as the second tracks, and the tracks 82 or 282 serving as the control tracks. However, the numeric quantity of the first tracks, the second tracks, and the control tracks is to be determined individually as necessary.

Furthermore, each of the embodiments described above is configured such that the track 62 or 162 (serving as the first tracks), and the track 72 or 172 (serving as the second tracks) intersect each other at a freely determined relative rotational position of the output shaft 16 (serving as the second rotor) with respect to the sprocket 11 (serving as the first rotor), and the bar-shaped control pin 50 (serving as the control member) passes through the point of intersection. However, the embodiments may also be configured such that the first track and the second track do not intersect each other at the given rotational position or at a freely determined rotational position of the second rotor with respect to the first rotor. In such a case, the control pins are placed in portions that pass through the first track and the second track separately.

In each of the embodiments mentioned above, the rotating member 24 or 240 (serving as the control rotor) is configured so as to rotate around the same rotation centerline 0 as the sprocket 11 (serving as the first rotor) and the output shaft 16 (serving as the second rotor). However, it is also possible to configure the rotating member 24 or 240 so as to rotate around a central axis that is arranged off-center from the rotational centerline of the first rotor and the second rotor.

Finally, in each of the embodiments described above, the torque application means is configured such that the torque applied to the rotating member 23 or 240 (serving as the control rotor) is generated by the electric motor 30. However, it is also possible to configure the torque application means such that the torque applied to the control rotor is generated by, for example, applying a break to a rotating member.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A valve timing adjustment device provided to a transmission system for transmitting drive torque from a drive shaft of an internal combustion engine to a driven shaft for opening and closing at least one of an air intake valve and an exhaust valve, adjusting the timing at which at least one of the air intake valve and the exhaust valve opens and closes, the device comprising:

a first rotor that rotates around a rotation centerline by the drive torque from the drive shaft;

a second rotor that rotates around the rotation centerline together with the rotation of the first rotor and in the same direction as the first rotor so as to make the driven shaft rotate synchronously, wherein the second rotor is capable of rotating relative to the first rotor; and control means having a control member, the control means varying the radial distance of the control member from the rotation centerline, wherein the first rotor defines a first hole forming a first track that extends so as to vary its radial distance from the rotation centerline, and the first hole makes contact with the control member that passes through the first track, with the contact between the first hole and the control member occurring at two sides of the first hole toward which the first rotor rotates;

the second rotor defines a second hole forming a second track extending so as to vary its radial distance from the rotation centerline, and making contact with the control member that passes through the second track, with the contact between the second hole and the control member occurring at two sides of the second hole toward which the second rotor rotates; and the first track and the second track slant toward each other along the rotational direction of the first rotor and the rotational direction of the second rotor.

2. The valve timing adjustment device according to claim 1, further comprising:

a plurality of the control members, wherein the first rotor and the second rotor each have a plurality of pairs of the first hole and the second hole arranged along the rotational direction, each pair corresponding to each of the plurality of control members.

3. The valve timing adjustment device according to claim 1, wherein the first track and the second track are straight.

4. The valve timing adjustment device according to claim 1, wherein the first track and the second track are curved.

5. The valve timing adjustment device according to claim 4, wherein the first track is formed as an expanded curved line expanding outwardly away from the radial center of the first rotor, and the second track is formed as an expanded curved line expanding outwardly away from the radial center of the second rotor.

6. The valve timing adjustment device according to claim 1, wherein the first track and the second track intersect each other at a place determined by rotational phase of the second rotor with respect to the first rotor, and the control member is formed as a bar, and passes through a place of intersection of the first track and the second track.

7. The valve timing adjustment device according to claim 6, wherein the control member has a rolling element both at the place where the control member makes contact with the first rotor, and also at the place where the control member makes contact with the second rotor.

8. The valve timing adjustment device according to claim 1, wherein the control means comprises:

a control member;

a control rotor rotating in the same direction as the first rotor together with the rotation of the first rotor and capable of rotating relative to the first rotor;

torque application means for applying advancement side torque and retardation side torque to the control rotor; and the control rotor defines a control hole forming a control track extending at a slant with respect to a radial axis line so as to vary its radial distance from the rotation centerline, the control hole making contact with the control member passing through the control track, with the contact occurring on both a radially inward side and a radially outward side of the control hole.

9. The valve timing adjustment device according to claim 1, wherein the control means comprises:

a control member;

a control rotor rotating in the same direction as the first rotor together with the rotation of the first rotor and capable of rotating relative to the first rotor;

torque application means for applying advancement side torque and retardation side torque to the control rotor, and supplementary energizing means for energizing the control member in one radial direction of the control rotor, and a control wall of the control rotor, the control wall having a control track extending at a slant with respect to a radial axis line so as to vary the radial distance from the rotation centerline, the control wall making contact with the control member that passes through the control track, where the contact occurs on either a radially inward side or a radially outward side of the control wall.

10. The valve timing adjustment device according to claim 9, wherein the control track is formed as an arc arranged off-center from the rotation centerline.

11. The valve timing adjustment device according to claim 9, wherein the control track is formed in a spiraling pattern.

12. The valve timing adjustment device according to claim 9, wherein the control track is formed straight.

13. The valve timing adjustment device according to claim 12, wherein ends of the control track are formed roughly perpendicular to the radial axis line.

14. The valve timing adjustment device according to claim 13, wherein the control means includes:

holding means for holding a rotational phase of the control rotor with respect to the first rotor at a time when the torque application means is not applying torque to the control rotor.

15. The valve timing adjustment device according to claim 14, wherein the torque application means has an electric motor for generating torque to be applied to the control rotor.

16. A valve timing adjustment device provided to a transmission system for transmitting drive torque from a drive shaft of an internal combustion engine to a driven shaft for opening and closing at least one of an air intake valve and an exhaust valve, adjusting the timing at which at least one of the air intake valve and the exhaust valve opens and closes, the device comprising:

a first rotor that rotates around a rotation centerline by the drive torque from the drive shaft;

a second rotor that rotates around the rotation centerline together with the rotation of the first rotor and in the same direction as the first rotor so as to make the driven shaft rotate synchronously and that is capable of rotating relative to the first rotor;

control means having a control member, and varying the radial distance of the control member from the rotation centerline; and energizing means for energizing the first rotor and the second rotor to advance one rotor with respect to the rotational direction, and retard the other rotor with respect to the rotational direction, wherein one of the first rotor and the second rotor has a first wall portion forming a first track extending so as to vary its radial distance from the rotation centerline, the first wall portion making contact with the control member that passes through the first track, with the contact occurring on the retardation side of the first track with respect to the rotational direction;

the other rotor has a second wall portion that forms a second track extending so as to vary its radial distance from the rotation centerline, the second wall portion making contact with the control member that passes through the second track, with the contact occurring on the advancement side of the second track with respect to the rotation direction of its rotor; and the first track and the second track slant toward each other along the rotational direction of the first rotor and the rotational direction of the second rotor.

17. The valve timing adjustment device according to claim 3, further comprising:

a plurality of the control members, wherein the first rotor and the second rotor each have a plurality of pairs of the first wall portion and the second wall portion arranged along the rotational direction, with each pair corresponding to each of the plurality of control members.

* * * * *